US007017234B2

(12) United States Patent
Anderson

(10) Patent No.: US 7,017,234 B2
(45) **Date of Patent: *Mar. 28, 2006**

(54) FOLDING TOOLS WITH LOCKING HINGES

(76) Inventor: Brent L. Anderson, 3145 WS Hwy. 152, Yoder, WY (US) 82244

( * ) Notice: Subject to any disclaimer, the term of this patent is extended or adjusted under 35 U.S.C. 154(b) by 287 days.

This patent is subject to a terminal disclaimer.

(21) Appl. No.: 10/895,436

(22) Filed: Jun. 30, 2003

(65) Prior Publication Data

US 2005/0097929 A1 May 12, 2005

Related U.S. Application Data

(63) Continuation-in-part of application No. 09/883,652, filed on Jun. 18, 2001, now Pat. No. 6,588,240.

(51) Int. Cl.
*E05D 11/10* (2006.01)

(52) U.S. Cl. ..... 16/332; 16/319; 294/53.5; 294/57; 7/116

(58) Field of Classification Search ..... 70/16–17; 16/230, 252, 319, 327, 111.1, 332, 334; 294/49, 294/50.5, 53.5, 57.59, 57–59; 7/116
See application file for complete search history.

(56) References Cited

U.S. PATENT DOCUMENTS

| | | | | | |
|---|---|---|---|---|---|
| 1,157,135 | A | | 10/1915 | Wesson et al. | |
| 1,509,355 | A | | 9/1924 | Hapgood | |
| 1,872,857 | A | | 8/1932 | Wesson et al. | |
| 2,966,787 | A | | 1/1961 | Tompkins | |
| 3,401,971 | A | * | 9/1968 | Cronquist | 294/53.5 |
| 3,473,712 | A | * | 10/1969 | Genchi | 7/116 |
| 3,618,345 | A | | 11/1971 | Smith | |
| 4,023,221 | A | * | 5/1977 | Cadman | 7/114 |
| 4,114,216 | A | * | 9/1978 | Gatby | 7/116 |
| 4,138,867 | A | | 2/1979 | Tompkins | |
| 4,287,731 | A | | 9/1981 | Kruger | |
| 4,300,368 | A | | 11/1981 | Sullivan | |
| 4,314,466 | A | | 2/1982 | Harris | |
| D267,468 | S | | 1/1983 | Simms | |
| 4,424,997 | A | | 1/1984 | Jackson | |
| 4,697,441 | A | | 10/1987 | Allen | |
| D298,205 | S | | 10/1988 | Pollak | |
| 4,840,048 | A | | 6/1989 | Elam | |
| 4,846,042 | A | * | 7/1989 | Wetty | 16/111.1 |
| 5,063,628 | A | * | 11/1991 | Campbell | 7/116 |
| 5,103,520 | A | | 4/1992 | Mazzo | |
| 5,138,852 | A | | 8/1992 | Corcoran | |

(Continued)

OTHER PUBLICATIONS

"Nato Approved Gerber Folding Spade," listed by the Preparedness Center about Apr. 23, 2003.

(Continued)

*Primary Examiner*—Brian E. Glessner
*Assistant Examiner*—Christopher Boswell
(74) *Attorney, Agent, or Firm*—James K. Poole, Esq.

(57) ABSTRACT

Folding tools including a tool blade and a handle are foldably connected by a lockable hinge which permits folding the assembly for compact storage but automatically locks into a rigid assembly when fully unfolded. The hinge operates by the movement of a locking bar into locking groove(s) via a tensioning mechanism when the hinge components are aligned in the unfolded, extended configuration. The lockable hinges can be used to connect the blade and handle components of a variety of common tools including shovels, saws and the like, and are disclosed and claimed in Applicant's U.S. Pat. No. 6,588,240.

33 Claims, 19 Drawing Sheets

U.S. PATENT DOCUMENTS

| | | | | |
|---|---|---|---|---|
| 5,205,142 | A | 4/1993 | Kruger et al. | |
| 5,461,890 | A | 10/1995 | LeFavor | |
| 5,485,655 | A | 1/1996 | Wang | |
| 5,507,051 | A * | 4/1996 | Mazon | 7/116 |
| 5,598,723 | A | 2/1997 | Ecker et al. | |
| 5,676,412 | A | 10/1997 | Kahley | |
| 5,687,593 | A | 11/1997 | Cross | |
| 5,697,231 | A | 12/1997 | Tobin | |
| 5,771,588 | A | 6/1998 | Petrich | |
| 5,799,996 | A | 9/1998 | Fredrickson | |
| 5,887,921 | A | 3/1999 | Rapoport et al. | |
| D426,436 | S | 6/2000 | Ng | |
| 6,357,067 | B1 * | 3/2002 | Jones | 7/116 |
| 6,560,805 | B1 * | 5/2003 | Dallas et al. | 7/116 |
| 6,588,240 | B1 * | 7/2003 | Anderson | 70/16 |

OTHER PUBLICATIONS

"Backpackers Folding Camping Shovel," listed by "The Preparedness Center"about Apr. 23, 2003.

"Glock Shovel with GI Carrying Case," listed at www.geocities.com about Apr. 23, 2003.

"6-N-1 Survival Multi-Purpose Tool," listed by "The Preparedness Center" about Apr. 23, 2003.

"5 in 1 Survival Tool,".

"Mini Folding Shovel," listed by "The Preparedness Center" about Apr. 23, 2003.

"All-in-One Outdoor Tool-Shovel, Saw, Hammer and Hatchet,"listed on "Camping Survival" May 9, 2003.

"Special Forces Shovel," listed by "Cold Steel" about May 5, 2003.

"Sven Saw," folding backpacker's saw, listed by "Camping Survival" about May 9, 2003.

"Texsport Folding Survival Shovel with Saw," listed by "a 1 camping.com" about May 9, 2003.

"U-Dig-It Stainless Steel Folding Hand Shovel," listed by The Preparedness Center about May 9, 2003.

"Rambo Knife," listed by the Preparedness Center about Apr. 23, 2003.

* cited by examiner

FOLDING TOOLS WITH LOCKING HINGES

REFERENCE TO RELATED APPLICATION

This application is a continuation-in-part of Applicant's U.S. Ser. No. 09/883,652 for "HINGE LOCK SAFETY CUFF," filed Jun. 18, 2001, now U.S. Pat. No. 6,588,240, which is incorporatred herein by reference in its entirety.

BACKGROUND OF THE INVENTION

1. Field of the Invention

The present invention relates generally to handcuffs for restraining prisoners or the like, and particularly to handcuffs which can be folded for storage or carrying via hinges but form a rigid structure when unfolded for use. The invention relates further to folding tools employing the patented locking hinges of the parent application to lock a tool blade into position in relation 2. Description of Relevant Art Handcuffs and other mechanical restraints have been used to restrict the activities of prisoners for hundreds of years. Many conventional handcuffs take the form of lockable cuffs linked by chains, other flexible connectors or by fixed, "rigid" connections such as a solid piece of steel. Many designs have been employed for various purposes and situations ranging from the arrest and restraint of suspects to long term confinement, transportation and court appearances. Different designs have attempted to provide improvements in such areas as ease of carrying by law enforcement officers, compact storage, ease of applying and locking the cuffs on a suspect during arrest, and security once applied and locked. In some cases, making handcuffs easier to carry, apply and lock have made them less secure; conversely, providing double and triple locking mechanisms may make the cuffs more complicated and more difficult to apply and lock on a struggling suspect. Hinged handcuffs have been produced which fold along a central hinge for carrying or storage, then open for application to the prisoner. Such hinged cuffs allow less freedom of movement for a cuffed subject, and in some cases the hinge can be locked open to provide a rigid structure. Such an arrangement can be useful when a law enforcement officer has applied a handcuff bracelet member to a suspect's wrist, as the rigid linking structure provides a convenient means for guiding the suspect or even enforcing the officer's will upon the suspect through uncomfortable pressure on the nerves in the wrist. Such rigid handcuffs and methods for their use are disclosed in U.S. Pat. No. 4,840,048, which is incorporated herein by reference.

Rigid handcuff designs offer better control over a struggling or resisting suspect, as they offer superior leverage with which to control the suspect and take him under control. However, a major shortcoming of "fixed" rigid handcuffs (such as disclosed in U.S. Pat. No. 4,840,048) is their storability. Such types of rigid handcuffs cannot be compactly stored on an officer's belt and often require a special carrying case.

Non-rigid handcuffs, commonly connected by flexible members such as chains or hinges, offer the benefit of occupying much less space when in their folded positions. However, they are not as easy to use or to apply to persons being restrained as is a rigid handcuff. Examples of non-rigid handcuffs are disclosed in U.S. Pat. Nos. 5,205,142; 5,138,852; 1,157,135 and 1,872,857.

U.S. Pat. No. 5,687,593 (to Hiatt & Co.) discloses a handcuff with the advantage of being able to assume a folded position, yet forming a rigid assembly when opened for use. A shortcoming of this invention is that even though it occupies less space than a fixed rigid handcuff by its ability to fold, it is still much bulkier than a common non-rigid handcuff and requires a special (larger) handcuff carrying case. The hinging and locking assembly is bulky and mechanically complex.

Many types of handcuffs and other restraints have been patented over the years, and patent activity continues vigorous to the present day, as the need persists for secure but humane restraint of suspects, prisoners and the like.

U.S. Pat. No. 4,314,466 discloses triple-locking handcuffs in which the cuffs are interconnected by conventional chains.

U.S. Pat. No. 4,138,867 discloses hinged handcuffs and lock, a set of handcuffs having two wings connected by a hinge, wherein the hinge sections are formed directly on the wing section walls and the handcuff locking mechanism operates as a hinge pin to hold the wing sections together, and also as a locking device. FIG. 11 illustrates the relationship of the hinge rings.

Kruger's U.S. Pat. No. 5,205,142 discloses hinged handcuffs. Kruger's U.S. Pat. No. 4,287,731 discloses an improved double lock assembly which can be used on handcuffs such as those of his '142 patent.

Despite all the development and testing of these relatively "low-tech" mechanical devices, improvements are still sought to obtain a better balance between convenience and ease of application and security. In particular, improvements are needed in hinged handcuffs which can be locked in an open position to provide a rigid structure for restraining prisoners, yet fold completely for storage. Similarly, although many folding tools are extant, e.g. the classic U.S. Army entrenching tool, the patented lockable hinges of the parent application can be employed in a variety of folding tools to provide easy folding for storage or carrying with the locking of a tool blade and tool handle into a rigid unit for use.

A brief survey has found a number of patents for folding tools, mainly shovels. U.S. Des. Pat. No. 426,436 illustrates folding shovel with a saw edge on one edge of the shovel blade, but does not elucidate the folding mechanism.

U.S. Pat. No. 4,424,997 discloses a foldable digging tool, apparently for use in gardening, in which a wire handle folds inside the shovel blade.

U.S. Des. Pat. No. 298,205 illustrates a shovel which apparently has a sliding handle.

U.S. Pat. No. 5,676,412 discloses a folding snow shovel in which the blade folds in half longitudinally and the handle comprises two sections which can be disconnected for compact storage.

U.S Pat. No. 6,357,067 discloses a multipurpose snow/ice tool combining a modified ice axe, a shovel blade and a "spike saw".

U.S. Pat. No. 5,799,996 discloses a multi-function hand tool combining a multi-section handle assembly and a plurality of tool heads for various applications.

U.S. Pat. No. 5,887,921 discloses a shovel having rotatable foot pedals atop "U-Dig-It Stainless Steel Folding Hand Shovel."

U.S. Pat. No. 4,023,221 discloses a multipurpose tool kit with a folding handle, comprising a shovel blade, devices to prevent relative motion between a tool blade and the handle, and a saw blade which may be mounted between ends of the partially folded handle to form a crude "buck saw".

U.S. Pat. No. 5,771,588 discloses a folding axe with a three-segment folding handle which can be folded to enclose the axe head for safety in carrying or storage.

U.S. Pat. No. 5,103,520 discloses a multipurpose hand tool which is partly foldable and includes numerous tool combinations. The tool can be folded to a compact stowed form or unfolded to various degrees to particular configurations for use of the available tools.

In addition to the shovels and other tools disclosed in the patents discussed above, brief market research has discovered a variety of tools on the market of indeterminate vintage which are relevant to the present invention, although not necessarily prior art. The Austrian pistol manufacturer Glock reportedly manufactures a folding shovel which can be used with a US. Army shovel carrier. "Cold Steel High Performance Knives" manufactures a non-folding "Special Forces Shovel" modeled after the Soviet "Spetznaz" shovel. "Camping Survival" sells an "All-in-One Outdoor Tool, Shovel, Saw, Hammer and Hatchet" as well as over a dozen varieties of folding shovels and other tools. "A1 Camping-.com" offers a Texsport™ Folding Survival Shovel with Saw. "The Preparedness Center" advertises a "Mini Folding Survival Shovel with Saw," a "Mini Backpack Shovel with Pouch," a "Backpackers Folding Camping Shovel" and a "U-Dig-It Stainless Steel Folding Hand Shovel." to a tool handle.

While folding tools are convenient and compact, the universal problem found in such devices is to provide lightweight, strong and certain means of locking the tools in their extended or unfolded position(s). Despite all these patents and products extant in the currently popular fields of tools for camping and survival purposes, none appear to employ devices resembling Applicant's patentable locking hinge to lockably secure tool blades in the operating postion relative to the handles of folding tools.

SUMMARY OF THE INVENTION

It is thus an object of the present invention to provide various tools which can be easily folded for convenient storage and carrying. Another object of the invention is to provide hinged tools which can be folded for storage and locked in an open, extended position for use in various tasks. A further object is to provide folding tools utilizing hinges which can form a rigid structure when locked in the open position. Still another object of the invention is to provide hinged folding tools which can be easily and quickly unfolded and locked in place to provide an operable tool such as a shovel. In summary, the broad object of the present invention is to provide folding tools which occupy minimal space when in the folded (storage or carrying) position, but are made rigid when opened for use with a tool blade properly oriented to the handle. Another object is to provide foldable rigid hand tools which can be carried conveniently by hikers or other field operators. A related object is to provide folding tools with various features which assist in camping or outdoor survival situations. A further object is to offer additional means of employing the rigidifiable foldable hinges disclosed and claimed in Applicant's parent application with the shovel blade and interchangeable blades which may be affixed to the handle for various purposes.

Various embodiments of the present invention, i.e. folding tool asemblies, employ at least one lockable hinge which comprises two hinge assembly components, each comprising a hinge platform and at least one hinge paw attached thereto (at opposite ends), each hinge paw forming a cylindrical opening which is rotationally attached to the center hinge rod so that the hinge paws are adjacent, preferably intertwined like the fingers of clasped hands, and can rotate in opposite directions on the rod. Retaining means are provided to keep the hinge assembly components in position, with the cylindrical openings of the hinge paws rotationally attached to the hinge rod, and mechanical means are provided for automatically locking the hinge paws to the center hinge rod when the hinge components are rotated to a predetermined position such as the fully opened position, normally forming a single plane. A first hinge assembly component should contain at least one hinge paw and the second hinge assembly component should contain at least one more hinge paw than the first, so that when the hinge paws intertwine when they are rotationally attached to the hinge rod. One set of the hinge paws can be mechanically attached to the center hinge rod to prevent it from rotation about the rod and retain the intertwined hinge paws in place. For example, a mechanical fastener can be installed to extend laterally through at least one hinge paw and the hinge rod passing through its cylindrical opening. Alternatively, at least one hinge paw can be mechanically attached to the hinge rod by at least one projection from the side of the hinge rod which interacts with at least one longitudinal groove in the inner cylinder wall of the cylindrical opening in the hinge paw.

Means are provided for unlocking the hinge paws when the hinge is locked, thus allowing the hinge assembly components to rotate to fold the hinge and the tool where it is employed. The hinge paws can be locked to the center hinge rod (to lock the hinge) by providing at least one longitudinal locking groove within the inner cylinder walls of each hinge paw, positioned such that all the grooves are in alignment when the hinge is in fully extended position (normally defined by the hinge assembly components forming a single plane), and a locking bar which is adapted to enter all of the grooves when aligned to lock them into position upon the center hinge rod. The locking bar is positioned in a longitudinal recess upon the surface of the center hinge rod, and is fitted with tensioning means to press the locking bar outward so that a portion of it enters the locking grooves when they reach alignment, with a portion of the locking bar remaining within the longitudinal recess to lock the hinge paws to the hinge rod. The tensioning means can be suitable springs (coil, leaf, etc.) installed under the locking bar. External access means such as a hole, rod or button are provided for exerting inward pressure upon the locking rod to force it from the locking grooves and back into its longitudinal recess to unlock the hinge paws and allow rotation of both paws and hinge assembly components.

The lockable hinges described above and claimed in the parent application have many useful applications for use as components of tools and the like. These hinges are particularly useful for interconnecting components of folding hand tools such as a tool blade and a handle. For folding shovels and the like, at least one hinge can be used to connect the blade and handle so that the tool locks in a fully extended position, forming a single plane as in the hinged handcuffs disclosed and claimed in the parent application, generally positioning the tool blade (i.e., shovel or spade) parallel to the handle. The hinges can also be connected to a tool blade and handle so that the blade forms an acute angle or is approximately perpendicular to the handle when the hinges are locked. This configuration is suitable for use with folding hoes, cultivators, weeding tools, axes, pickaxes and the like. In some cases it can be useful to employ more than one lockable hinge connecting handles to a blade or tool, e.g. a drawknife with handles which can be folded parallel to the blade for storage but lockably extended to a working position approximately perpendicular to the blade.

Indeed, Applicant's patented hinges can be used to assemble almost any hand tool having a handle and a blade or tool section into a compact, foldable version. These compact, foldable tools are of particular interest where space and weight are at a premium, e.g. mobile military units, law enforcement units, survival equipment for a variety of individuals and organizations and fire fighters who may be air transported or even parachuted into forest areas to fight fires. During the Iraq War of 2003, it was reported that members of a U.S. Army Special Forces unit rescuing U.S. prisoners of war were required to literally dig with their hands to recover the remains of deceased prisoners on site. In retrospect, a few lightweight folding shovels as disclosed herein would have been very helpful.

The lockable hinges are attached to the tool blades and handle of the various types of folding tools by conventional and suitable mechanical means, much as they were connected to the handcuff bracelets of the parent application. A portion of the hinge can be configured to accommodate simple wooden handles prepared from tree limbs, poles and other materials available in the field. Preferably, however, a handle comprising wood, lightweight metals or polymeric composite materials is provided as part of the unit. Such handles can take any suitable form, having cross sections which are circular, oval or rectangular. Such handles can be provided in full length, or can be folding or retractable themselves to save further space. By using hollow tubular handles, a good strength-to-weight ratio can be attained, and the interior space can be used to hold additional tools which can be withdrwn when needed. Certain portions of the tools and handles can be perforated to reduce weight, consistent with required strength criteria, and in applications relating to aircraft or spacecraft, metal alloys or advanced composites combining light weight and high strength can be used.

Among the tools which can be so accommodated within a hollow tool handle are folding tools comprising a handle connecting to a cutting blade or other tool blade by lockable hinges of the invention. Such a blade can have a knife edge and/or a saw blade and comprise hooks or other features which make them suitable for use as weapons or survival tools. For example, one tool blade can combine a knife cutting edge, a section of saw teeth suitable for use as a saw or for scaling fish, and guiding means at the tip for guiding a fishing line. The tip can also include at least two fork tines which can be used in various cooking applications or even for extracting a fish hook from the throat of a large fish. As with many previous entrenching tools or survival shovels, a perpendicular member can be included at the and of the handle to assist in the use of the shovel or other tool. Such perpendicular members can be used for storage of additional useful devices, comprising compasses, simple fishing reels and storage for hooks, lures, bait, matches and other important survival items.

Additional objects and advantages of the present invention are described in, and will be apparent from, the following detailed description of certain preferred embodiments, together with the drawings and appended claims.

DETAILED DESCRIPTION OF PREFERRED EMBODIMENTS

It should be understood that the following description of some presently preferred embodiments of the present invention is merely representative of many possible embodiments and thus is not intended to limit the scope of the present invention. In the following description, like structures will be referred to by similar numerical designations. In some figures, some features may be omitted to clarify the illustration of the remaining features. The term "and/or" is used in the conventional sense, meaning A or B alone or A+B.

Figure 1:
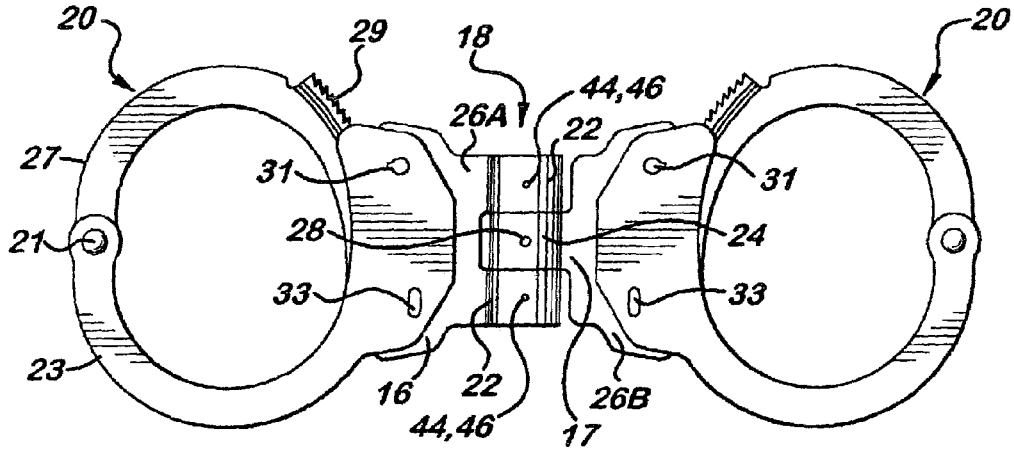
FIG. 1 is a top view of the Hinge Lock Safety Cuff (HLSC) in the locked opened (or rigid) position.
Figure 2:
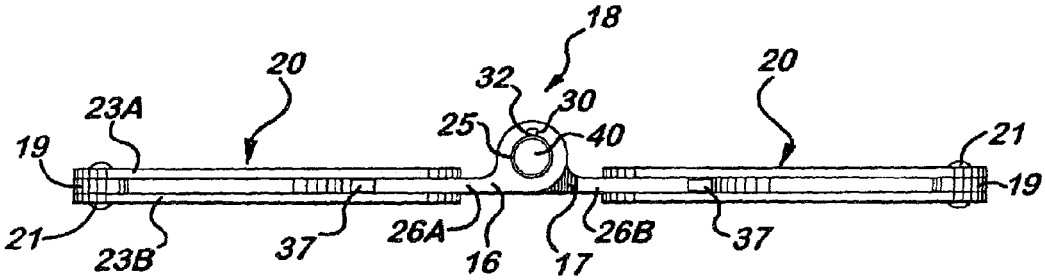
FIG. 2 is a side profile view of the HLSC of FIG. 1 in the locked opened (or rigid) position.

Turning now to the drawings, FIGS. 1 and 2 illustrate a hinge lock safety cuff 18 using the lockable hinge of the present invention in the open and locked position. The invention employs conventional (swing-through) handcuff wrist bracelets 20 which are adapted to be connected with hinges. Suitable bracelets are manufactured by Smith and Wesson and many other suppliers, and are disclosed in U.S. Pat. No. 5,205,142, which is incorporated herein by reference. As shown, the bracelets include a generally arcuate jaw member 27 having ratchet-like teeth 29 at one end and a second arcuate member 23 comprising two parallel components 23A and 23B. These two components are rotatably hinged together with pin or rivet 21 or the equivalent so that pin 21 passes through holes in the swivel ends (19) of members 23 and 27 and jaw member 27 is able to rotate between the components 23A and 23B of member 23. FIG. 2 shows portions of the open spaces (37) through which jaw member 23 rotates. Ratchet section 29 on jaw member 27 enters the base portion of member 23 to lock the cuffs by conventional means (not shown here). Suitable locking mechanisms are disclosed in U.S. Pat. No. 5,205,142 and many other sources. Keyhole 31 is provided for locking the cuffs by conventional key means. Slot 33 is preferably provided for double locking the cuff bracelets, as disclosed in U.S. Pat. No. 4,287,731, which is incorporated herein by reference. Such wrist bracelets can be similar to many models on the commercial market, including the Universal Handcuff and Hinged Handcuff made by Smith and Wesson, the Ultra Light Hinged Handcuff, Oversized Hinged Handcuff and A-550 Handcuff made by American and the Standard and Hinged handcuffs made by Peerless. Suitable cuff bracelets are also disclosed in U.S. Pat. No. 4,138,867, which is incorporated herein by reference.

Double hinge paw 22 and hinge platform 26A are components of a hinge assembly component 16, one solid piece of steel which fits together in intertwined manner with single hinge paw 24 by means of a single center hinge rod 40 (attached to hinge component 17, including hinge platform 26B). Hinge platforms 26A and 26B can be attached to the cuff bracelets by any suitable conventional means which is adapted to the commercial bracelets employed. Although these conventional attachment means are not shown here, the hidden ends of the hinge platforms which attach to the bracelet members can be shaped like those shown in FIG. 3 of U.S. Pat. No. 5,205,142. These hinge platforms can be mechanically fastened to the larger ends of the bracelet members 23 by spot-welding, pins, rivets or other suitable means (not shown). Hinge component 16 includes two hinge paws 22 which are bent or otherwise shaped to form cylindrical holes 25 which fit rotatably about center hinge rod 40. Similarly, single hinge paw 24 of hinge assembly component 17 also has a hole 25 (not shown here) which fits about pin 40 when the single hinge paw 24 is fitted between the twin hinge paws 22 of hinge component 16. The hinge components as well as the bracelet components can be formed by conventional industrial methods such as forging or stamping from various steels or other strong metal alloys.

It should be noted that the interconnected double hinge paw and single hinge paw shown here are but the simplest and most practical form for hinged connection of handcuff bracelets, and are shown here to demonstrate basic functions of the present invention. Although less practical, variations on the same theme could serve the same function, with possible advantages of strength and durability. A double hinge paw interconnecting with a triple paw or a triple paw interconnecting with a quadruple paw are possible combinations. The objective is to provide hinge paws and sections thereof which intertwine like the fingers of clasped hands, one hinge paw typically having one section more than the other.

Hinge platforms 26A and 26B are connected to the handcuff wrist bracelets 20 by conventional connecting means such as rivets, pins or welds commonly used in the manufacturing of handcuffs.

Figure 3:
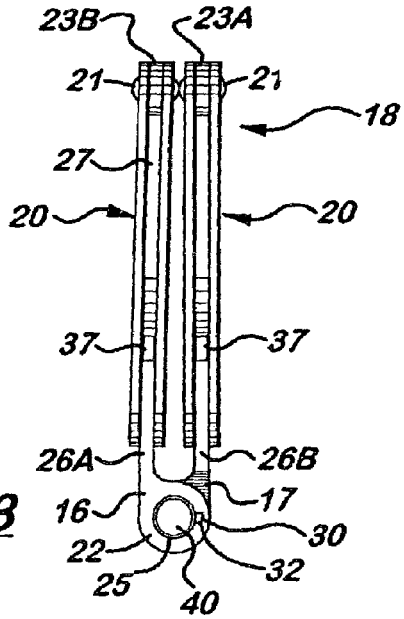
FIG. 3 is a side profile view of the HLSC in the folded "storage" position.
Figure 4:
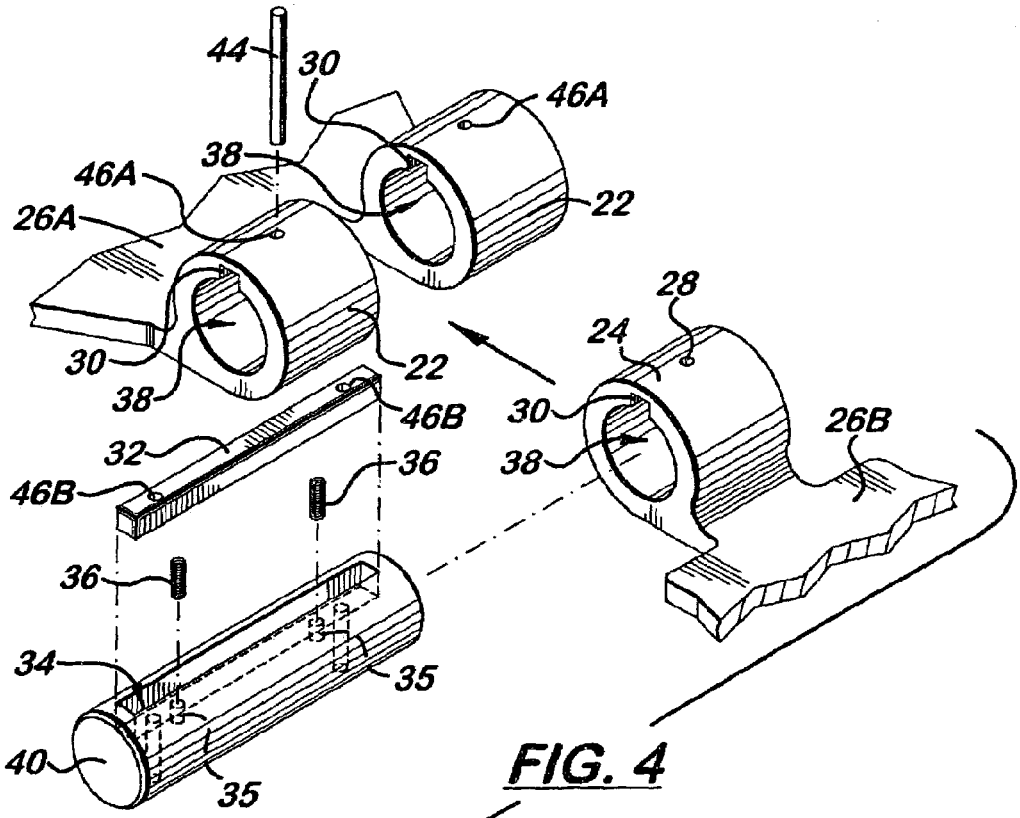
FIG. 4 is an exploded perspective view of the HLSC hinge and its internal components.
Figure 5:
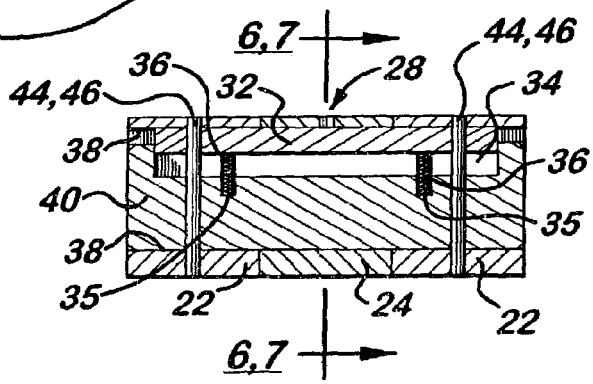
FIG. 5 is a longitudinal sectional view of the center hinge rod, detailing the position of the locking bar, locking bar pocket, internal springs, and the (2) fixed stabilizing pins.

Depression access hole 28 in single hinge paw 24 allows for the insertion of the backside of a common handcuff key or object of similar size and shape (i.e., about 2 mm in diameter and at least about 5 mm long) for the purpose of contacting locking bar 32 (shown in FIG. 4). Pressing down thus on locking bar 32 causes coil springs 36 to compress. (At least two coil springs 36, made of conventional spring steel, fit into holes 35 inside locking bar recess 34 and serve to keep locking bar 32 in position in locking grooves 30 in hinge paws 22 and 24. Compression of springs 36 allows locking bar 32 to be pushed out of locking grooves 30, allowing hinge paws 22 and 24 to be rotated about rod 40 so that the cuffs can be folded into the storage position, as shown in FIG. 3.) Locking grooves 30 include rectangular grooves (milled or cut into interior cylinder walls 38 of hinge paws 22 and 24) which act as a receptacle for locking bar 32 when all grooves in the hinge paws are aligned.

Figure 6:
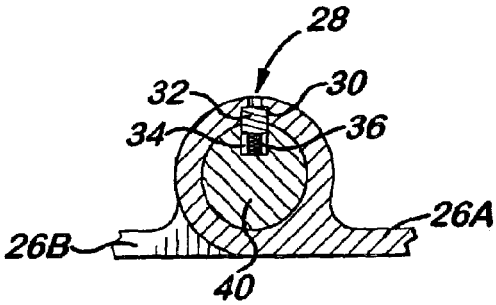
FIG. 6 is a cross sectional view of the center hinge rod demonstrating the locking bar pressed into the locking groove by the upward tension of the springs, with cuffs unfolded.
Figure 7:
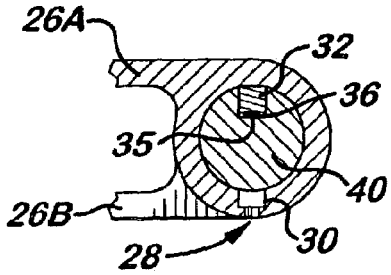
FIG. 7 is a cross sectional view demonstrating the locking bar in the depressed position and restrained by the inner cylinder walls of the hinge while cuffs are in the closed "storage" position.

Locking bar 32 should be sized and finished to slide easily into locking grooves 30 and provide a close fit for security when in place. This will normally result when bracelets 20 are aligned to form a single plane with hinge assembly components 16 and 17, as shown in FIGS. 1, 2 and 6. To engage locking bar 32 into locking grooves 30, it is necessary that the grooves 30 in all three (or more) paws be aligned. When the hinge is in the folded, storage position (FIG. 3), these locking grooves 30 are misaligned, which causes locking bar 32 to be restrained against the inner cylinder walls 38 of the single hinge paw 24 and double hinge paw 22, as shown in FIG. 7. Once the handcuffs are fully opened to a flat profile (i.e., with hinge assembly components 16 and 17 forming a single plane) as in FIGS. 1, 2, 4 and 6, the locking grooves 30 become aligned and the locking bar 32 is engaged. When the hinge is thus locked, it creates a rigid pair of handcuffs.

Figure 10:
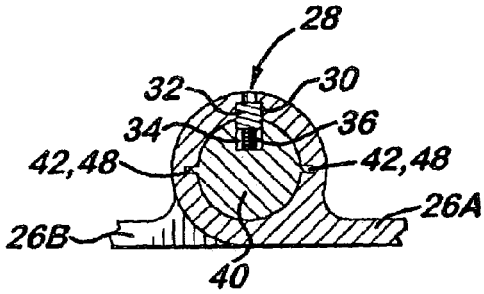
FIG. 10 is a variation of the sectional view of FIG. 6, demonstrating the locking bar pressed into the locking groove by the upward tension of the springs.
Figure 12:
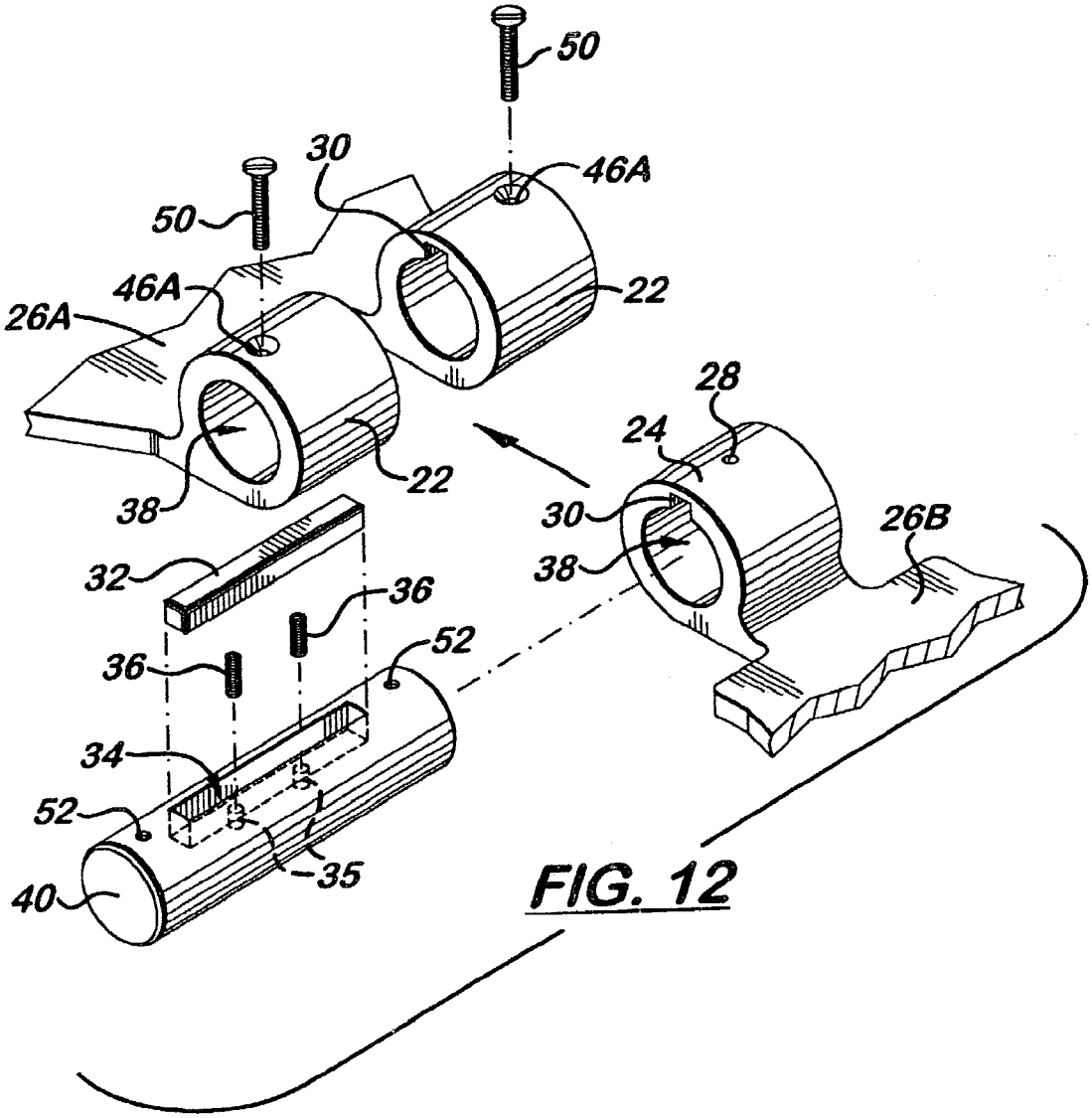
FIG. 12 is a variation of the exploded view of FIG. 4, illustrating alternative means of securing the assembled parts in place.

As shown in FIGS. 6 and 10, locking bar 32 sits in locking bar recess 34 in center hinge rod 40. Locking bar recess 34 is sized and finished to allow locking bar 32 to slide smoothly in and out through pressure from springs 36. Locking bar 32 is retained in recess 34 by the three sides and two ends of recess 34 and by the inner cylinder walls 38 of double hinge paw 22 and single hinge paw 24. The locking bar 32 is constantly pushed toward inner cylinder walls 38 by a tensioning mechanism such as coil springs 36 in FIGS. 4 and 8. This tension pushes locking bar 32 into locking grooves 30 in double hinge paw 22 and single hinge paw 24 when these locking grooves are aligned on all three hinge paws. Locking bar recess 34 retains coil springs 36 below the locking bar 32, with springs 36 seating in holes 35 at the bottom of recess 34. Locking bar 32 is of course formed of material having sufficent bulk and strength to prevent the locked cuffs from being forced out of alignment, preferably high grade steel or other suitable metal alloy. While locking grooves 30 are shown open at the outer surfaces of double hinge paw 22 for clarity, they can optionally be closed or obstructed to prevent access to locking bar 32 when the cuffs are unfolded, as shown in FIG. 12.

While coil springs 36 are shown for the tensioning mechanism, any suitable spring or other tensioning means could be used. For example, at least one leaf spring could be placed in locking bar recess 34 below locking bar 32, extending the full length of the locking bar recess. The exact size and form of the spring or other tensioning means are not critical, so long as sufficient pressure is exerted upon locking bar 32 to force it quickly and reliably into locking grooves 30 when they come into alignment, and the physical properties of the spring or other means permit this action to be dependably reproduced many times. Alternatively, or in addition to mechanical tensioning means, locking bar 32 could be drawn into locking groove 30 by a powerful magnet placed therein, provided metals of appropriate magnetic properties are used in fabrication of these parts.

Inner cylinder walls 38 are the bored out or machined internal portions of double hinge paw 22 and single hinge paw 24, and are suitably finished to allow smooth rotation of the parts and locking of the handcuffs when extended to the open position. Center hinge rod 40 is a solid rod of steel or other suitable metal or alloy, with locking bar recess 34 cut, machined or otherwise formed in the top lengthwise portion of its body. Locking bar recess 34 is positioned to hold locking bar 32 in place, as discussed above. Center hinge rod 40 holds double hinge paw 22 and single hinge paw 22 (and thus, the cuffs) together, and is large enough and strong enough to prevent any foreseeable bending or damage by a restrained prisoner. The use of such a single center hinge rod permits a compact handcuff assembly, whether in folded or extended positions.

FIG. 4 illustrates that double hinge paw 22 can be secured to center hinge rod 40 by suitable mechanical means, such as the two stabilizing pins 44 which pass through holes 46A and 46B in double hinge paw 22 and locking bar 32, respectively. Holes 46 (and pins 44) also continue through center hinge rod 40. This restraint causes center hinge rod 40, locking bar 32 and double hinge paw 24 to move together as one unit, thus allowing single hinge paw 24 to rotate freely around center hinge rod 40 until locking in the rigid extended position. Stabilizing pins 44 can be any suitable mechanical fastener such as frictional pins, rivets, bolts (e.g., headless Allen bolts) or the like.

Figure 8:
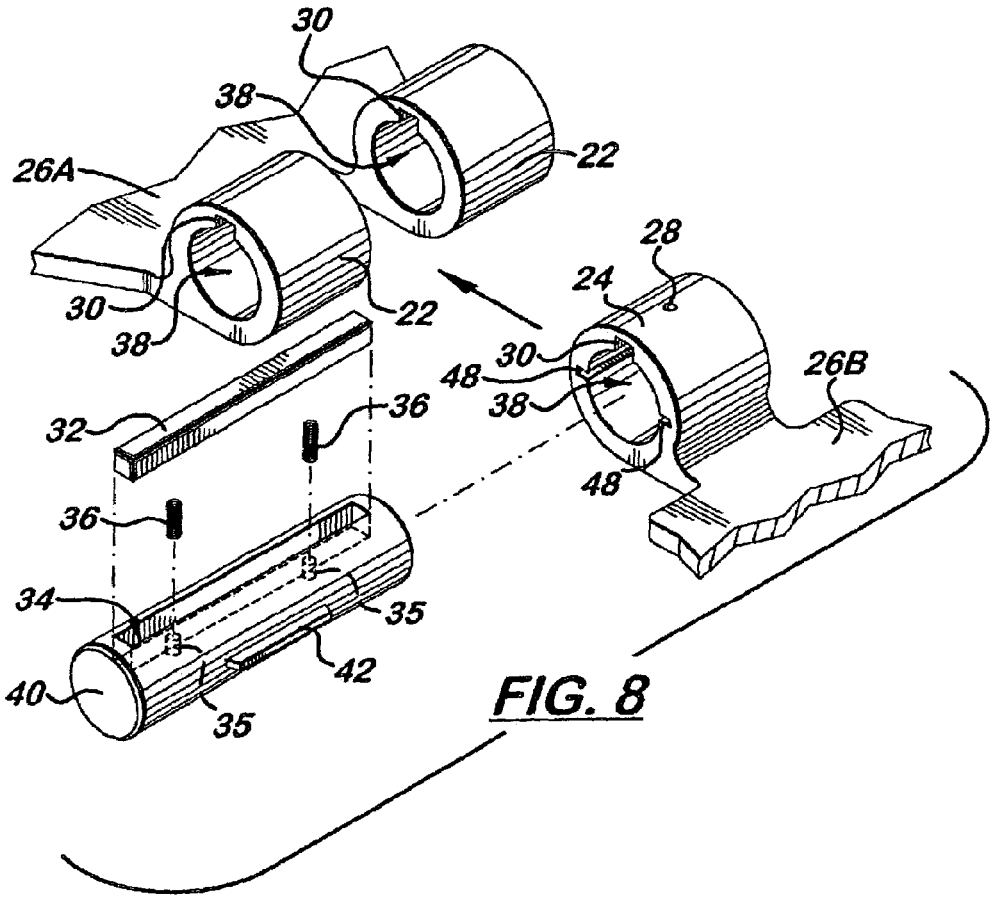
FIG. 8 is a variation of the exploded view of FIG. 4, adding a longitudinal pair of "wings" on the center hinge rod and accompanying hinge grooves to accommodate insertion of the wings. Removed are the (2) fixed stabilizing pins.

FIG. 8, a variation of FIG. 4, illustrates that center hinge rod 40 can also be secured within inner cylinder wall 38 of single hinge paw 24 by means such as the two solid hinge rod projections or wings 42 (on opposite sides of rod 40), which are slid into two corresponding hinge wing grooves 48 in the cylinder wall 38 of single hinge paw 24. This would cause center hinge rod 40 and single hinge paw 24 to rotate together as a unit, allowing double hinge paw 22 to rotate freely about center hinge rod 40 until the cuffs lock in the rigid extended position. Similar grooves 48 are also provided in cylinder walls 38 of at least one of the double hinge paws 22 to allow center hinge rod 40 with wings 42 to be slid into place during assembly. Thus, center hinge rod 40 can be affixed to either of the hinge paws 22 or 24 (or equivalent units) to form a unit, with the remaining hinge paw rotating freely about hinge rod 40. Hinge wings 42 can be formed by welding, forging and machining or other suitable means (e.g., molding or milling from one piece of steel) to form a component which is strongly attached to hinge rod 40, and is long enough to correspond to the width of single hinge paw 24 without extending beyond it.

Figure 9:
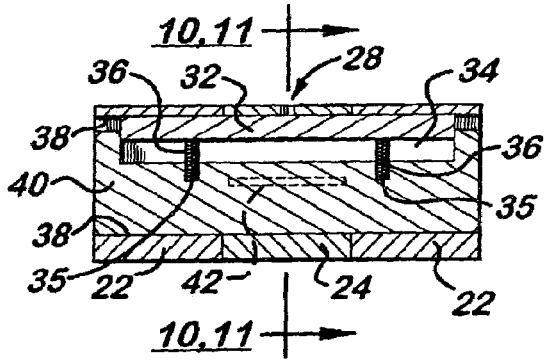
FIG. 9 is a variation of the sectional view of FIG. 5, detailing the position of the locking bar, locking bar recess, internal springs, and the position of the attached "wings".
Figure 11:
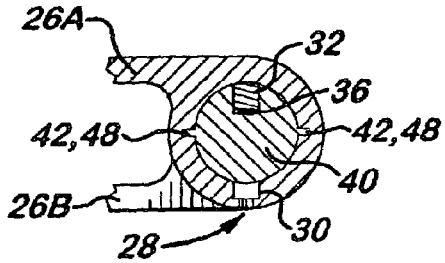
FIG. 11 is a variation of the sectional view of FIG. 7, demonstrating the locking bar in the depressed position and restrained by the inner cylinder walls of the hinge while cuffs are in the closed "storage" position.

The placement of these components is shown in more detail in FIGS. 9,10 and 11. It is apparent that upon unfolding the cuffs so as to align all locking bar grooves 30, springs 36 or other tensioning means will force locking bar 32 into grooves 30. Since locking bar 32 also remains partially within locking bar recess 34 in center hinge bar 40, the hinge paws (and thus the cuffs) will be prevented from rotation or other movement until locking bar 32 is depressed sufficiently via the application of force through hole 28 in single hinge paw 24 (or other central equivalent hinge paw) to unseat locking bar 32. Since the cuffs automatically lock into the rigid unfolded position when unfolded sufficiently to align grooves 30, they can be easily placed in this position during or after application of the cuffs to a subject.

In operation, the cuffs are closed and folded together via the hinge for storage or contained in a suitable carrying case which can be kept on an officer's belt or other convenient location. The single hinge rod construction permits a very compact folded assembly. When a prisoner or suspect is to be restrained, the cuffs are generally unfolded and opened. It may be necessary to unlock each cuff to open same. With the subject's hands in position, a cuff is applied to at least one hand and locked automatically. The remaining cuff is then applied to the subject's other hand, or to a stationary object if desired. The cuffs can then be double-locked if desired. When the cuffs are fully unfolded into the locked or "rigid" position, the prisoner will be unable to alter their positions. While the rigid form of the cuffs thus applied may pose a hazard when the subject is placed in certain positions or falls, this may serve as a deterrent to prevent disruptive behavior. When the subject is restrained with the cuffs in locked position, significant leverage is available through the hinge of the cuffs to guide the subject in his actions, by force if necessary.

Figure 13:
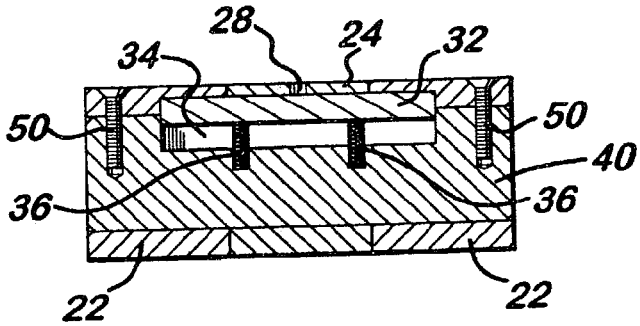
FIG. 13 is a longitudinal sectional view of the hinge of FIG. 12.

FIGS. 12 and 13 illustrate an embodiment in which machine screws 50 are inserted through holes 46A in double hinge paws 22 and screwed into threaded holes 52 in center hinge rod 40 to secure hinge paws 22 to rod 40. In comparison to FIG. 4, locking grooves 30 can be closed as shown in FIG. 12, for increased security.

While the lockable hinge of the present invention has been discussed above and illustrated for a preferred embodiment of hinged, lockable handcuffs, the hinge itself can be employed in a wide variety of portable tools and the like to provide for compact storage or carrying. For example, the handle and business end of tools such as shovels, paddles, chopping or cutting tools can be joined with the lockable hinge so that they can be folded for storage, but extended and locked securely in position for use. For example, a folding camp shovel could have the shovel blade attached to the handle by the lockable hinge. Similarly, the blades of various chopping or cutting tools can be attached to their handles by the hinge, which locks the blades into working position when unfolded. As an alternative to simply folding such blades back upon a handle (such as a camp shovel and handle), handles of wood or other suitable materials can be provided with a recess which accommodates tools such as knife or saw blades when folded for storage. In addition, the handles themselves, or other suitable implements such as fishing rods, tent poles, gun cleaning rods, batons and the like, can be joined by at least one such locking hinge to permit more compact folded positions for storage. The lockable hinges can also be used to attach handles to wheeled devices such as toy scooters, luggage carriers, grocery carts and the like, again to provide for compact storage and convenience.

Figure 14:
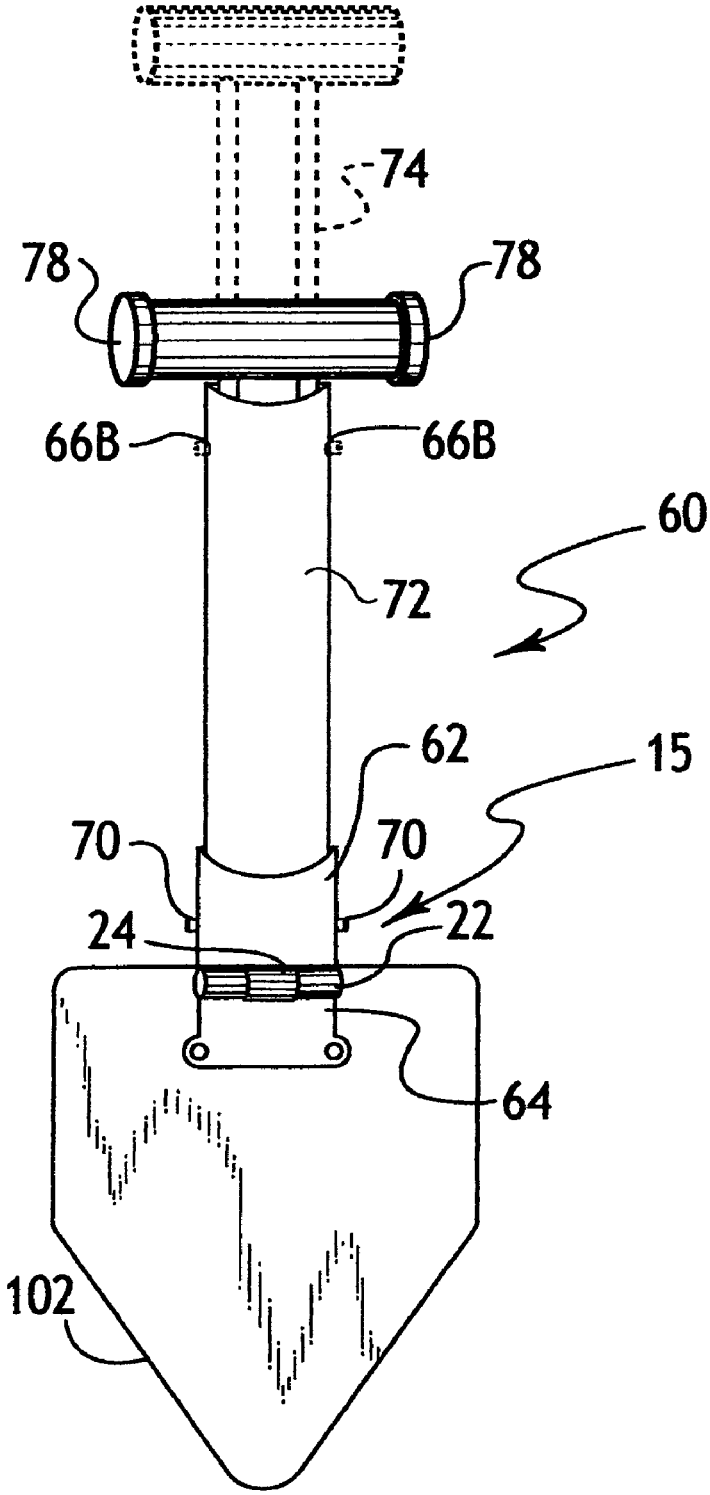
FIGS. 14 and 14' are plan views of a folding shovel of the invention with a lockable hinge and a retractable handle, FIG. 14' showing tool within hollow handle.
Figure 14:
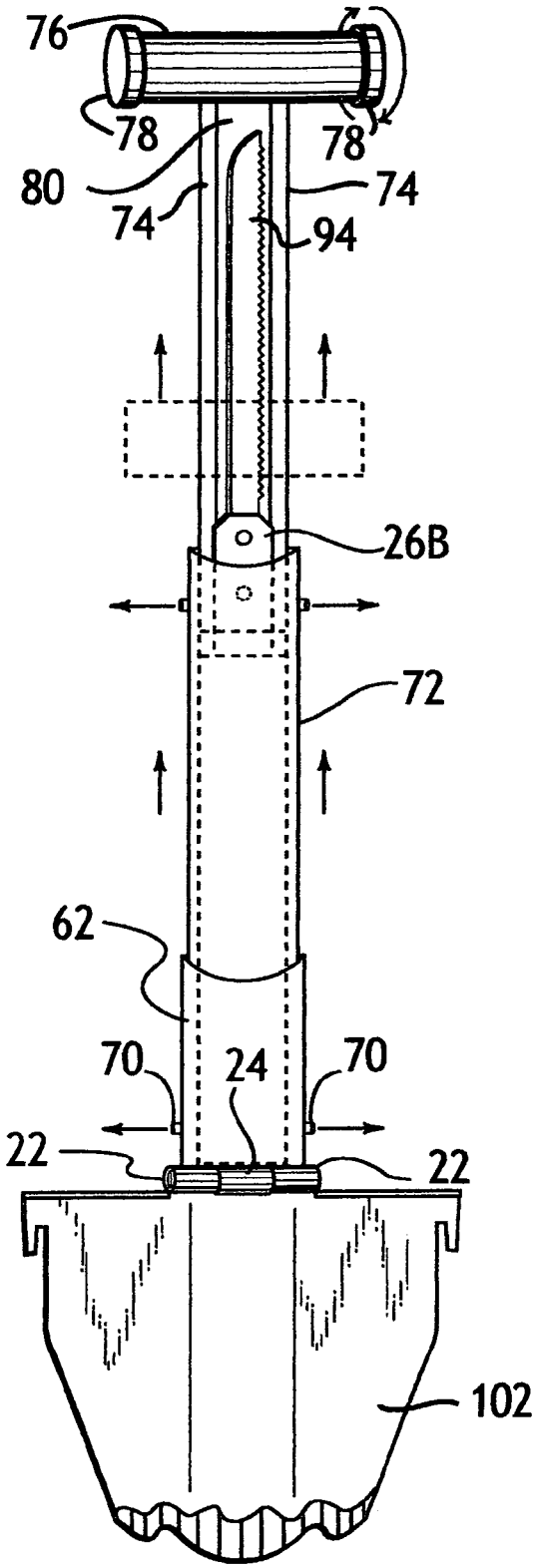

Further in accordance with the present invention, FIGS. 14 through 20 illustrate various embodiments of the invention other than handcuffs. FIG. 14 shows the survival shovel multi-tool 60 in the open position for use and the internal handle 74 in its most compact position. The dotted "ghost" drawing shows internal handle 74 in the extended position, which would allow for extra leverage while digging. Shovel blade 102 and shovel handle 72 are attached via the locking foldable hinge 15 of FIGS. 4 and 6 through 13. Shovel blade 102 could have any variety of suitable shapes appropriate for digging and could alternatively have tool functions built into the design of the blade, as depicted in FIG. 14'. Such functions could include a flat hammer head surface and nail puller, a wire cutter or bottle opener. Shovel blade 102 could be formed of a variety of hard metals, composite materials or combinations thereof. One option, for example, could include a rugged, lightweight composite material for the main body of shovel blade 102, with a narrow metal blade attached to the digging end (not shown here), thus providing an effective tool with reduced weight. FIG. 14 also shows a view of handle locking buttons 70, protruding from holes 66A, which serve to keep internal handle 74 in place. These buttons could be round, square or any shape suitable for their intended purpose. Buttons 70 should be made of hard materials able to withstand repeated use and the force of digging while holding the handles in place.

Shovel handle connector 62 is made of metal or comparable materials of equal hardness. This connector includes the single hinge paw 24 of the lockable hinge 15 on one end and a cylindrical opening (not visible here) at the opposite end. The cylindrical opening attaches to the main shovel handle 72. The shovel handle connector 62 and shovel handle 72 could be formed as one continuous part rather than two parts as shown in FIGS. 14 and 14'. Such handles and/or connectors could be made in any shape or form to incorporate the hinge paw 24 for hinged attachment to a variety of tools or weapons.

Figure 14A:
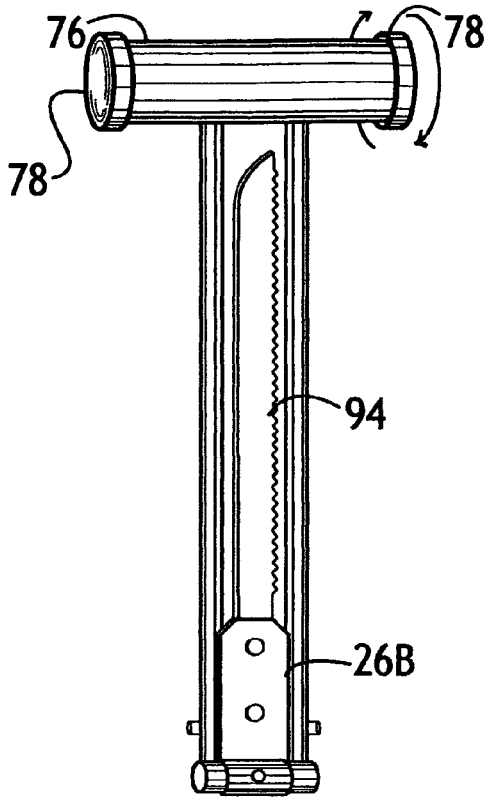
FIG. 14A is a plan view of the retractable portion of the handle of FIG. 14.
Figure 14B:
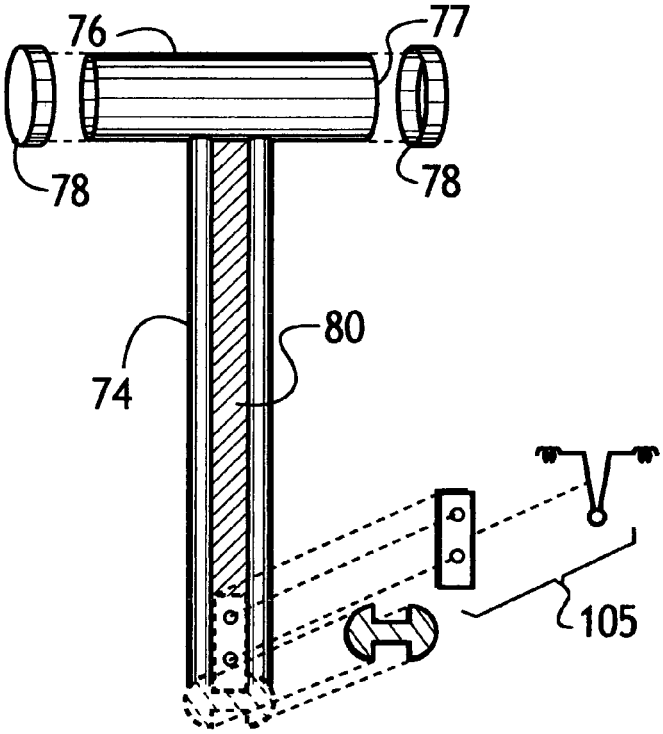
FIG. 14B is an exploded plan view of the handle portion of FIG. 14A.
Figure 14C:
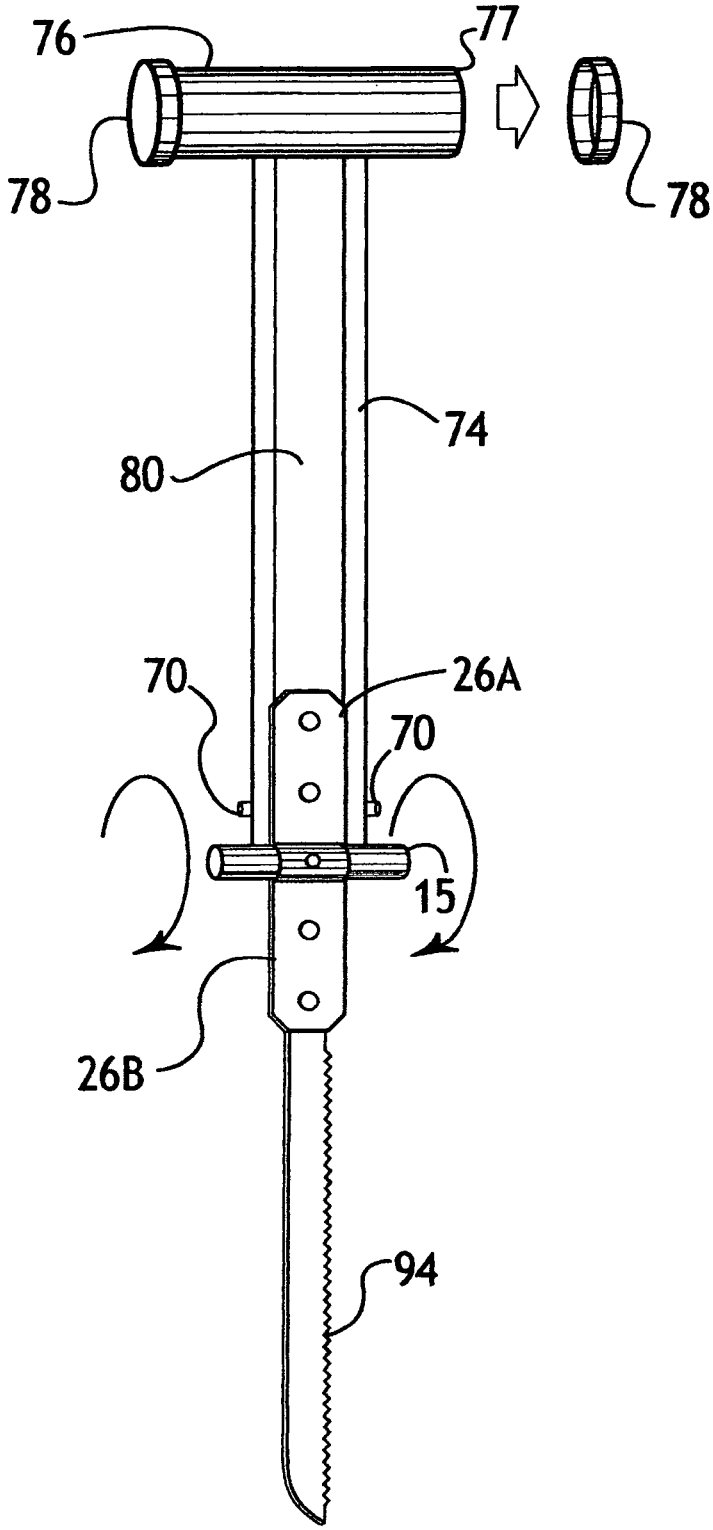
FIG. 14C is a plan view of the handle portion of FIGS. 14A and 14B, illustrating the unfolding of the sawblade contained therein to operating position.
Figure 14D:
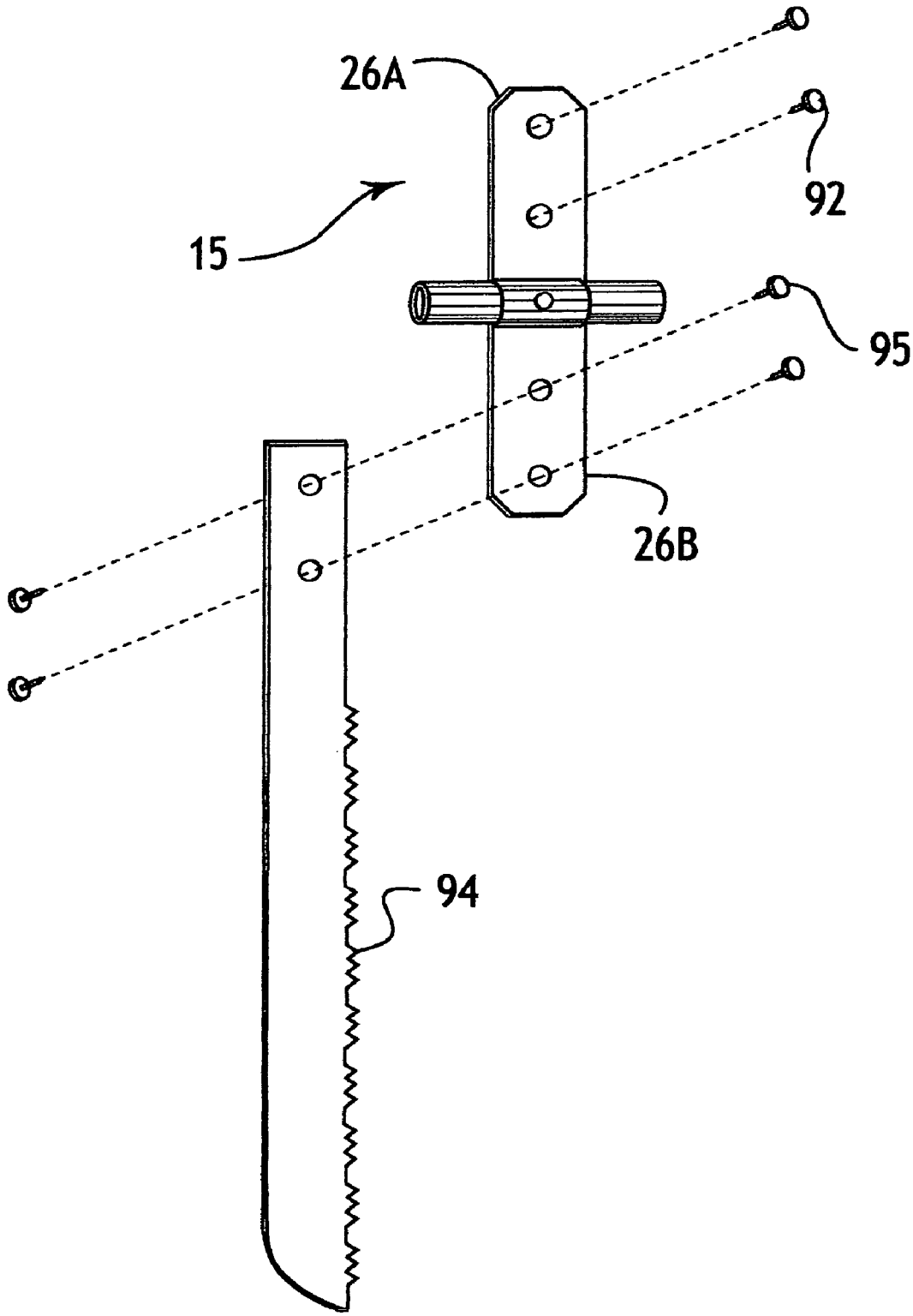
FIG. 14D is an exploded view illustrating the attachment of the sawblade of FIG. 14C to a lockable hinge of the invention.
Figure 14G:
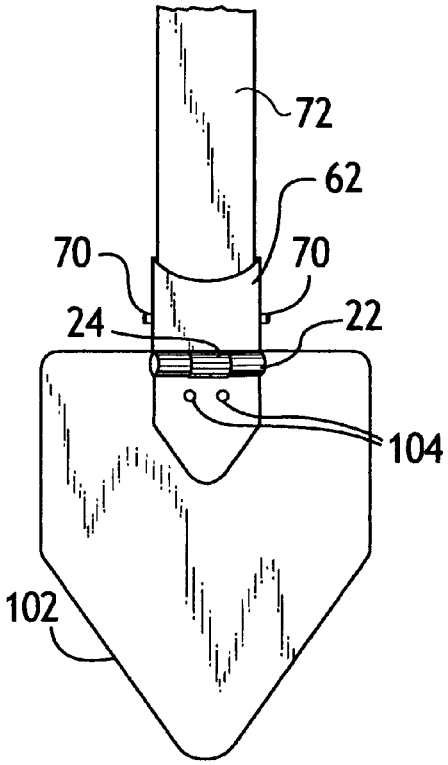
FIG. 14E illustrates sawblades and other tool blades which can be employed with the handle of FIG. 14C.
FIG. 14F is an exploded view illustrating the attachment of a lockable hinge of the invention to the handle of FIG. 14C, and FIGS. 14G and 14H are plan and exploded views illustrating the attachment of a shovel blade to a handle using a lockable hinge of the invention.
Figure 14H:
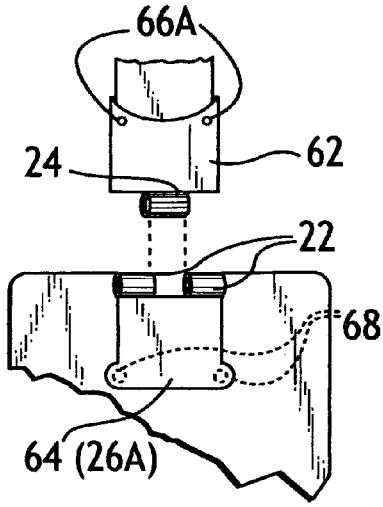

Hinge platform 64 is connected to shovel blade 102 via holes 68 with mechanical connectors such as screws, bolts, rivets and the like, and/or industrial adhesives, as shown in FIGS. 14G and 14H. The hinge platform can also be formed of metals or other suitable materials of equal hardness. Hinge platform 64 also comprises double hinge paw 22 of the lockable hinge. Upper holes 66B are provided in shovel handle 72 to allow the shovel handle to be expanded or lengthened. Several pairs of such holes could be provided, positioned along the length of shovel blade 72, serving the dual purpose of providing for variable handle lengths and reducing overall weight.

Handle locking buttons 70 comprise an outward tensioning mechanism (shown in FIG. 15B) and engage holes 66A or 66B. The tensioning means can comprise a flat piece of spring steel, coil springs or other suitable fittings installed in an internal cavity 80 of internal shovel handle 74. The cavity of handle 74 can also be used to store tools, as shown in FIG. 14'.

Figure 18:
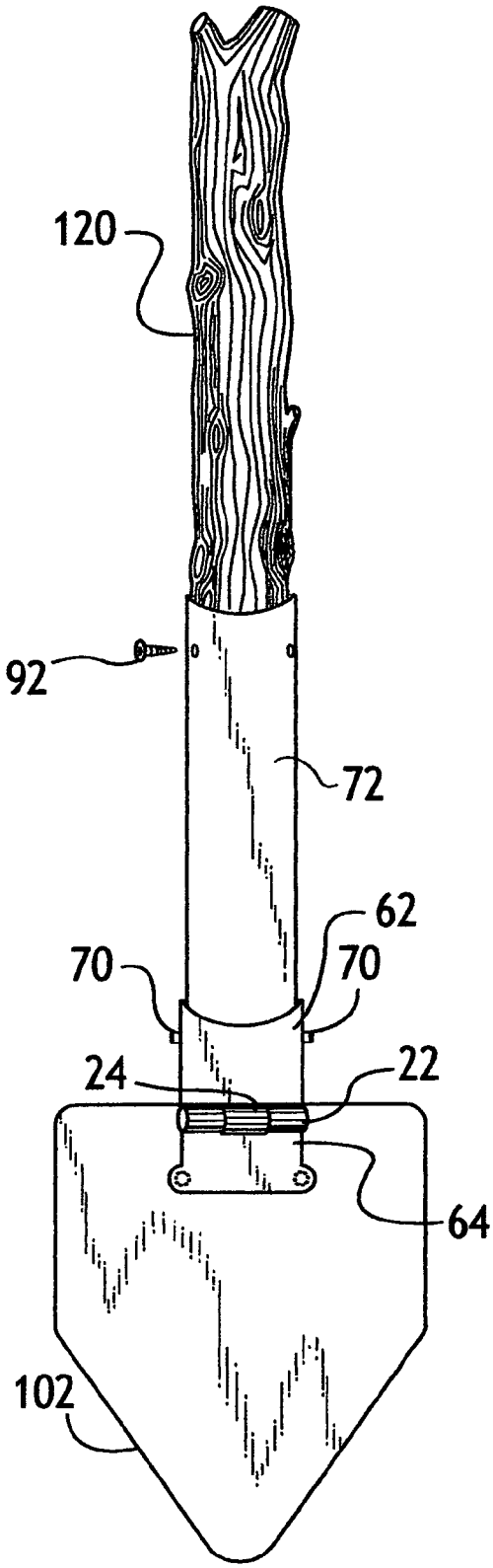
FIG. 18 is a plan view of a folding shovel of the invention fitted with a temporary field handle.

Shovel handle 72 serves as a conventional grasping handle for digging and similar activities, and as an external shell to receive internal shovel handle 74. Handle 72 can also receive other handles made of wood, metal or other suitable materials. If needed, a tree limb 120 or similar pole can be used as a "field" handle, as shown in FIG. 18.

Figure 19:
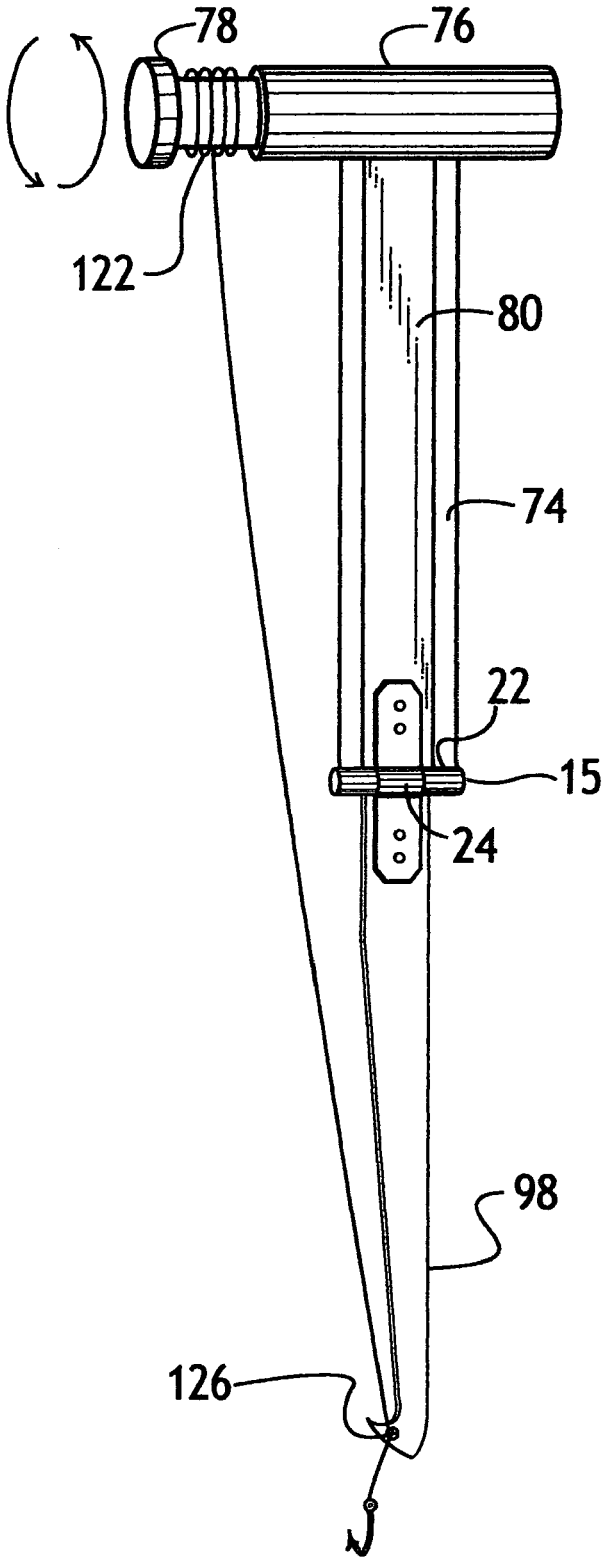
FIG. 19 is a plan view of the retractable handle portion of FIGS. 14, 14' 14A through 140 and 16 with a hooked blade attached in locked operating position and a built-in fishing reel configured for use.

Handgrip 76 (See FIGS. 14, 14' and 14A–14C.) attaches perpendicular to internal handle 74, providing a hand grasp or grip for digging with the assembled shovel. It can also be used as a handle or grip for other tools when the internal handle is removed. Handgrip 76 is preferably hollow, providing storage space 77 for survival gear such as a compass, signal mirror, matches and striking surfaces and the like. Cavity 77 is enclosed by end caps 78, which can be threaded or tight frictional fits. Caps 78 can also be used to store small survival items, spare parts and the like, as shown in FIG. 19B.

Figure 14E:
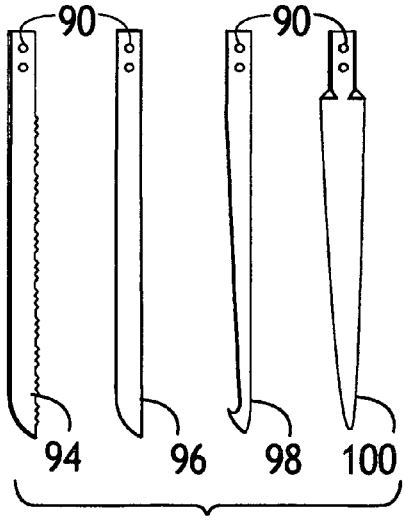
Figure 14F:
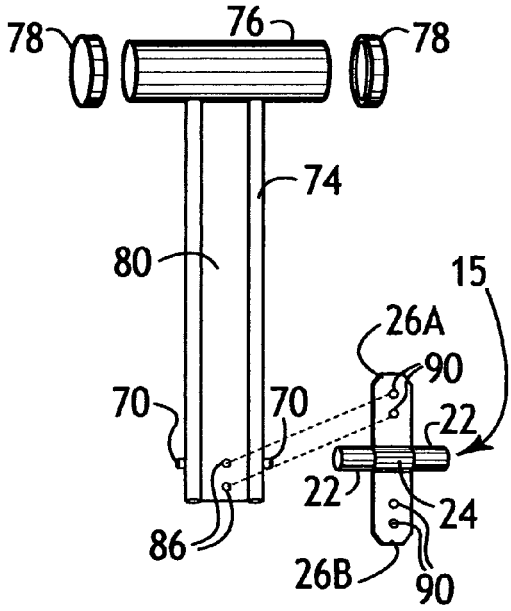

As shown in FIG. 14F, internal handle 74 is provided with at least two holes 86 near its distal end within storage cavity 80 to allow for the attachment of a hinge platform 26A of another lockable hinge, using holes 90 and suitable mechanical fasteners 92 as described above. Tools (shown in FIG. 14E) such as saw 94, machete 96, spear or harpoon 98 and pick tool 100 can be attached to the other hinge platform 26B of a hinge attached to internal handle 74, as shown in FIGS. 14C and 14D. Such tools can be attached by mechanical fasteners such as sheet metal or machine screws or bolt-nut combinations. Bolts and wing nuts permit installation and tightening without the need of additional tools. Once one of these tools is installed on internal handle 74 and the hinge is locked in its extended position, the tool can be used effectively for the intended purpose. As shown in FIG. 14A, one of the tools can be folded against internal handle 74 and stored within handle 72 in that position.

Figure 17:
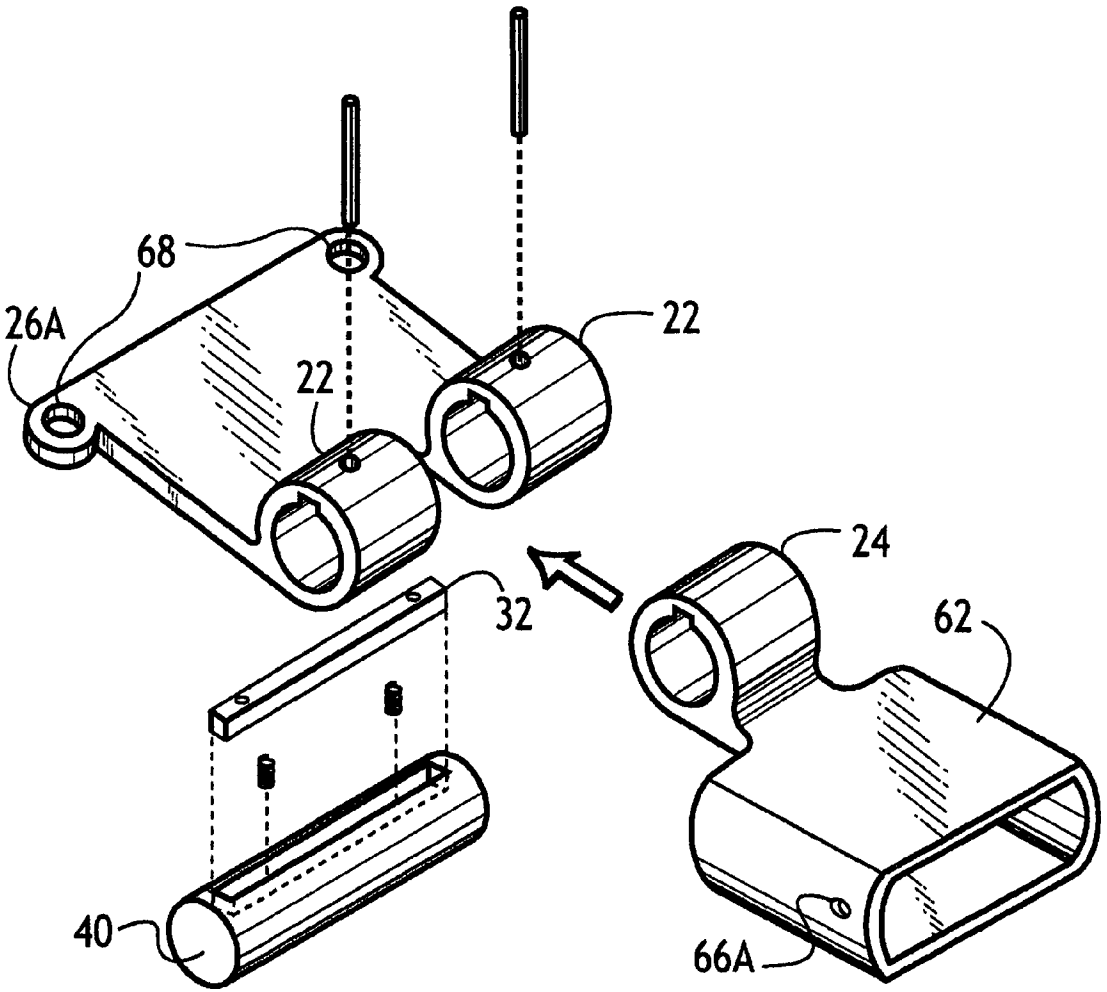
FIG. 17 is an exploded view illustrating the operation of Applicant's patented lockable hinge as applied to folding tools.

FIGS. 14A, 14C and 14F show the internal handle 74 completely, revealing the functions and features hidden within. The tools (94, 96, 98, 100) of internal handle 74 are attached via a foldable locking hinge 15 of varying, suitable size, as illustrated in FIGS. 4 and 6 through 13. The tools and hinges are attached together mechanically via holes 90. Internal handle 74 could also employ a standard lock blade function common in many lock back or lock blade knives (not shown here). The lockable hinge of the patented hinge lock safety cuff, however, is much stronger and safer to use with sharp-edged tools or weapons. In the unlikely event that the lock did fail under high stress use, the cutting edge of the blade would not fall back on the user's fingers, which would cause serious injury. This is one failing of typical lock blade knives and tools where lock failure will most assuredly cause an injury. As shown in FIG. 17, the center hinge rod 40 also contains a spring-loaded steel locking bar 32 which locks across all of the hinges for a full inch or more of locking surface contact. If one considers how a high quality lock blade knife is held in position with no more than about ⅛ inch of surface contact, it is readily apparent how rugged and strong the patented hinges used in the present invention are.

Internal handle 74 could alternatively have an internal cavity and shape to support a spring-loaded "switch blade" type of knife or tool. The push of a button could project such a blade out of the hinge end (if the hinge were not present) and into a locked position. This type of function might be appealing to military personnel as a form of weapon or could add to its speed and utility as a spear-fishing tool. Simple firearms such as rimfire, small caliber, single or double shot models could be built into internal handle 74, and would be useful in hunting small game in survival situations.

Figure 15:
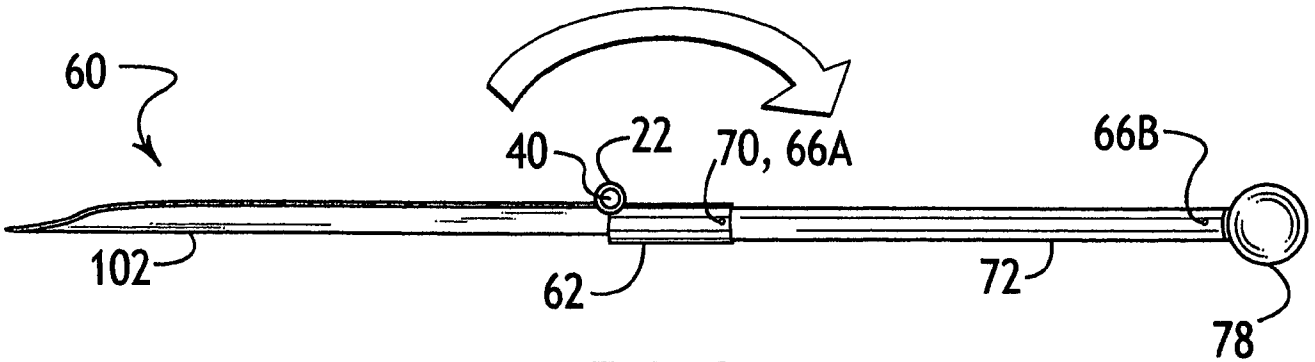
FIGS. 15 and 15A are side views illustrating the folding of a shovel of the invention.
Figure 15A:
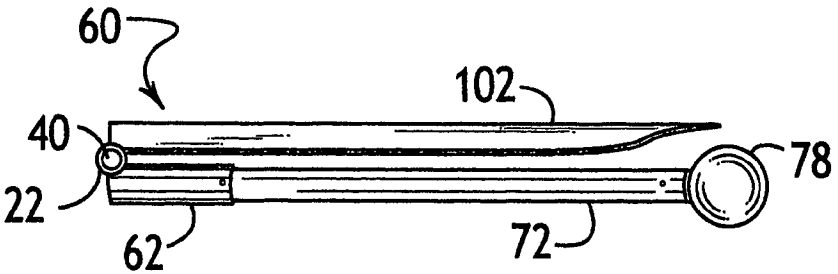
Figure 15B:
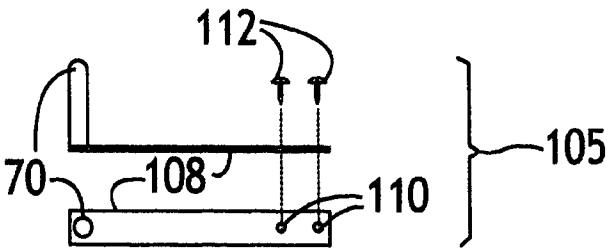
FIG. 15B provides side and plan views of a tensioning mechanisim for locking buttons.

FIGS. 14B and 15B show one example of a tensioning mechanism 105 for locking buttons 70. Any combination of springs 108 which exert outward tension would be suitable for this purpose. Alternatively, two strong magnets held in place with reverse polarity (i.e., repelling each other) could perform this type of function.

FIG. 14C shows hinge 15 in the open or locked position. Hinge 15 could be designed to project beyond the edge of internal handle 74 as a means of creating a type of cross guard. For such a design, shovel handle 72 would have to be engineered in such a way as to accept such a configuration. Alternatively, the shape and size of the locking buttons 70 could be designed to serve the same purpose of a cross guard.

FIG. 14D shows one means of attaching the chosen tool (saw 94) to the lockable hinge 15 of the internal handle 74 via suitable mechanical fasteners 92 such as screws, bolts, nuts and the like. A form of reliable snap lock connected with a push button release could also be used to attach tool blades to internal handle 74.

FIG. 14E shows various types of tools (94, 96, 98, 100) which could be attached to internal handle 74. The types and functions of such tools or weapons are almost unlimited. They could include specialty tools for such functions as cleaning horses' hooves, files, doubled-edged short swords or daggers, multi-pronged forks, spear points, spoons or fishing rods.

FIG. 15 is a side view of the shovel 60 in the opened or locked position. It can be seen that in addition to the locked hinge 15, the top of the shovel blade 102 (opposite the digging end) butts firmly against the end of the shovel handle. This configuration tends to reinforce the strength of the locking hinge by removing much (if not all) of the stress on the hinge while used as a digging tool.

FIG. 15B shows another alternative embodiment of the locking buttons 70 attached (e.g., welded or riveted) to spring platform 108, which is preferably a piece of high tension spring steel. The flat piece of spring steel would be screwed or fastened with suitable mechanical fasteners 112 flush to the side of the internal shovel cavity 80 with the buttons protruding through holes 66. Platform 108 is thus able to flex and allow locking buttons 70 to be pushed in when shovel handle 72 is installed in handle connector 62 or removed therefrom.

Figure 16:
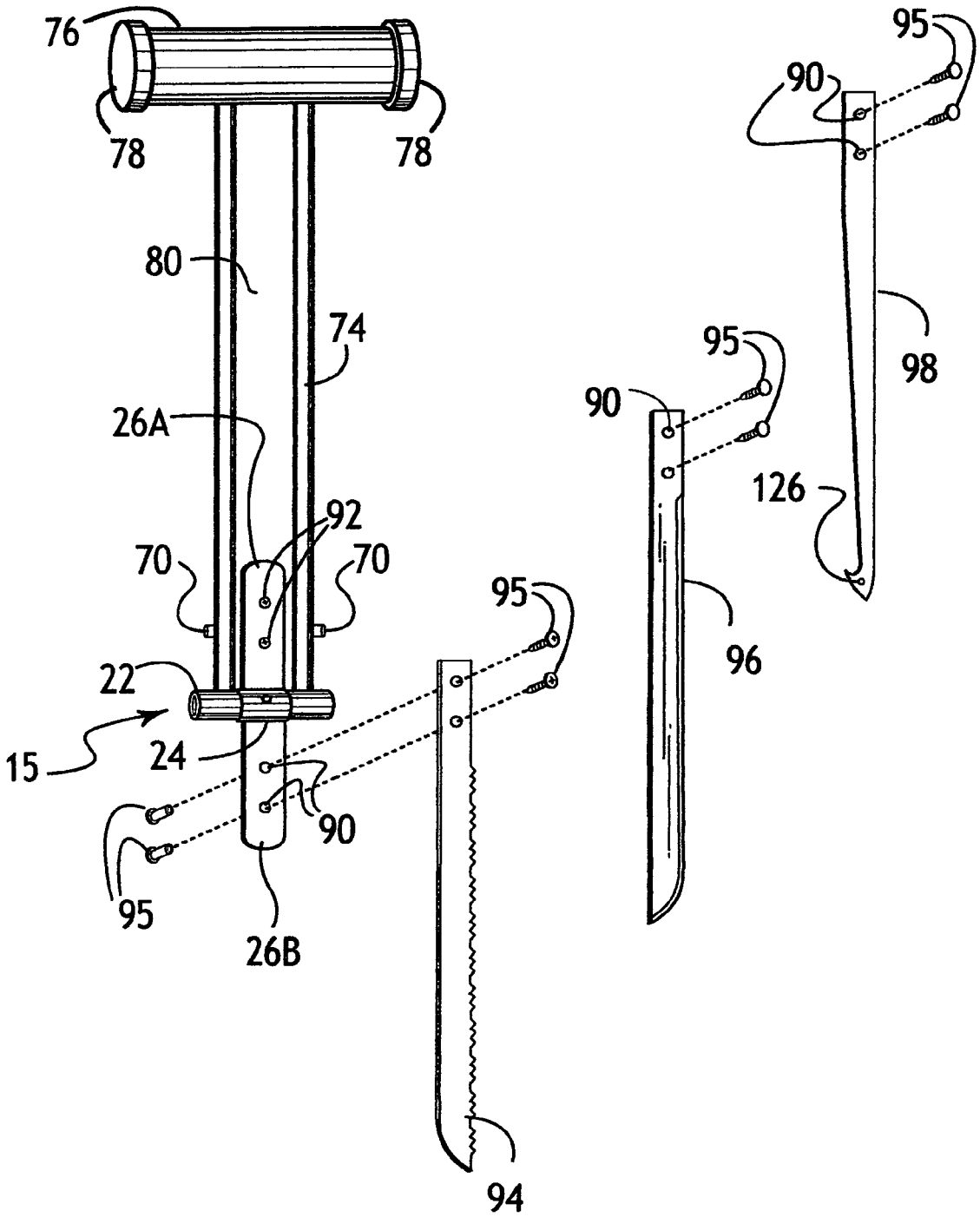
FIG. 16 is an exploded view illustrating the handle portion of FIG. 14 and interchangeable blades and tools which can be hingedly attached thereto.
Figure 16A:
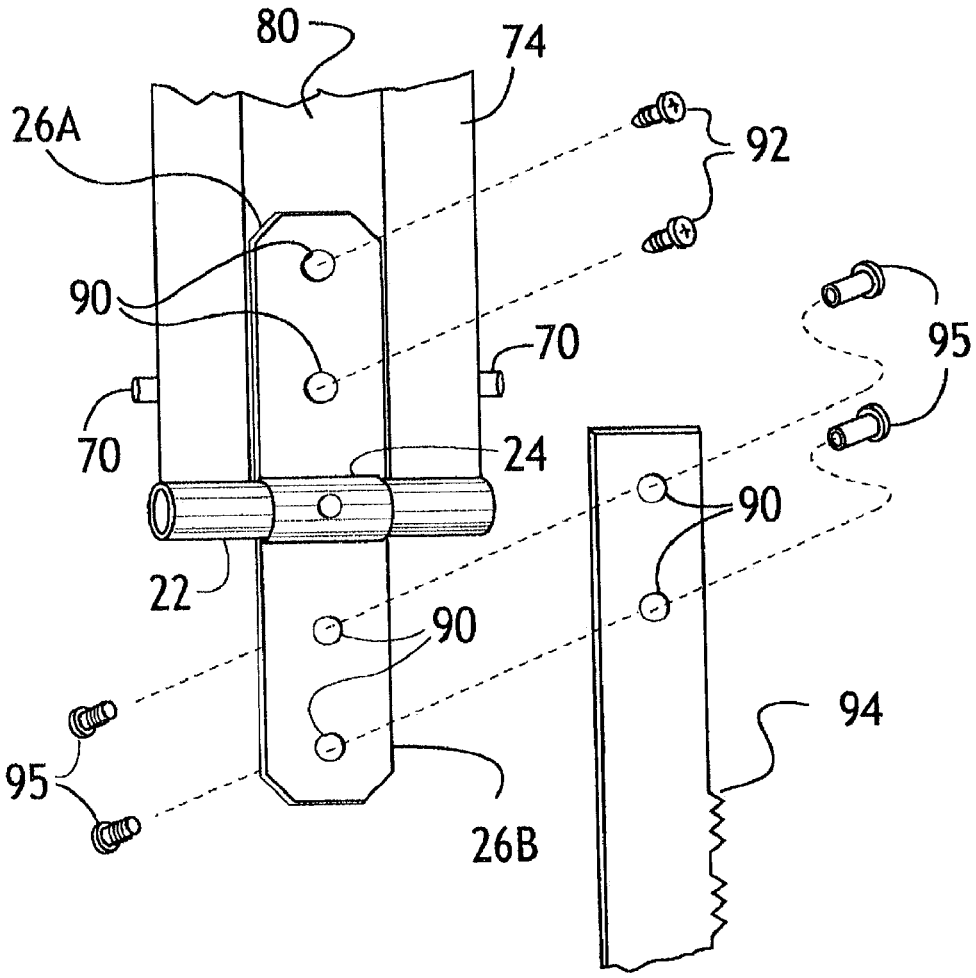
FIG. 16A is a detail exploded view of the attachment of a saw blade to the hinge and the handle portion of FIG. 16.

FIGS. 16 and 16A illustrate essentially the same features as FIG. 14D. Tools 94, 96 or 98 are shown as attaching to hinge platform 26B of hinge 15 via holes 90 therein, using machine screw-tee nut combinations 95.

Figure 16B:
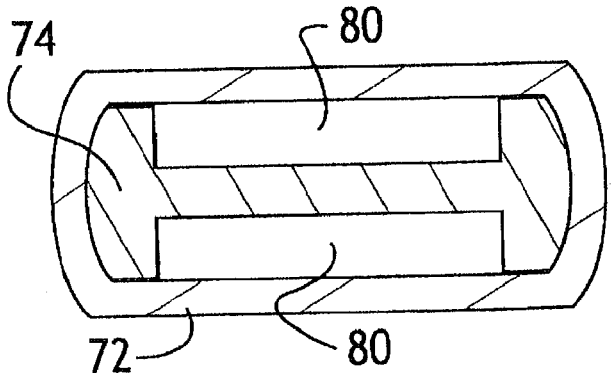
FIG. 16B is a sectional view of the handle portion of FIG. 16 showing the internal handles, the tool storage cavity and the shovel handle.

FIG. 16B shows one possible shape of the cross section of shovel handle 72 in relation to the internal shovel handle 74. The shape could vary from round to square, with internal cavity 80 varying in size and shape to provide storage for items of various shapes and sizes. It should be noted that while hinge 15 folds a tool attachment onto one side of internal handle 74, there is yet another storage cavity 80 for storing other tool attachments or survival items.

Figure 20:
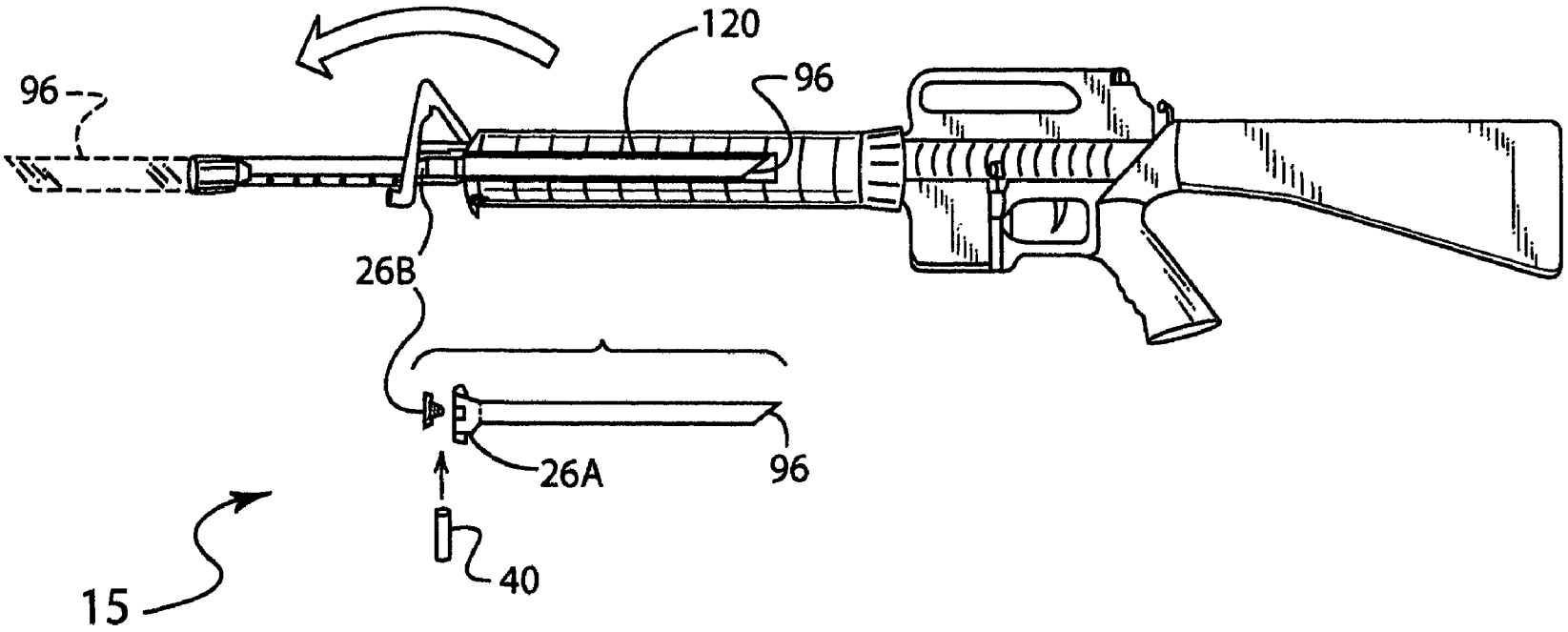
FIG. 20 illustrates a knife or bayonet installed to fold against the forestock of a military rifle with lockable hinges of the invention.

FIG. 17 shows a variation of the hinge 15 of FIGS. 4, 8 and 12. Such hinges can be formed to accomodate attachment to any device or mechanism which would benefit from having a lockable hinge. Examples include attaching a bayonet to a rifle barrel or other component (as shown in FIG. 20), a door to a wall, connecting two or more sections of a folding staff, baton or walking stick, etc.

Figure 17A:
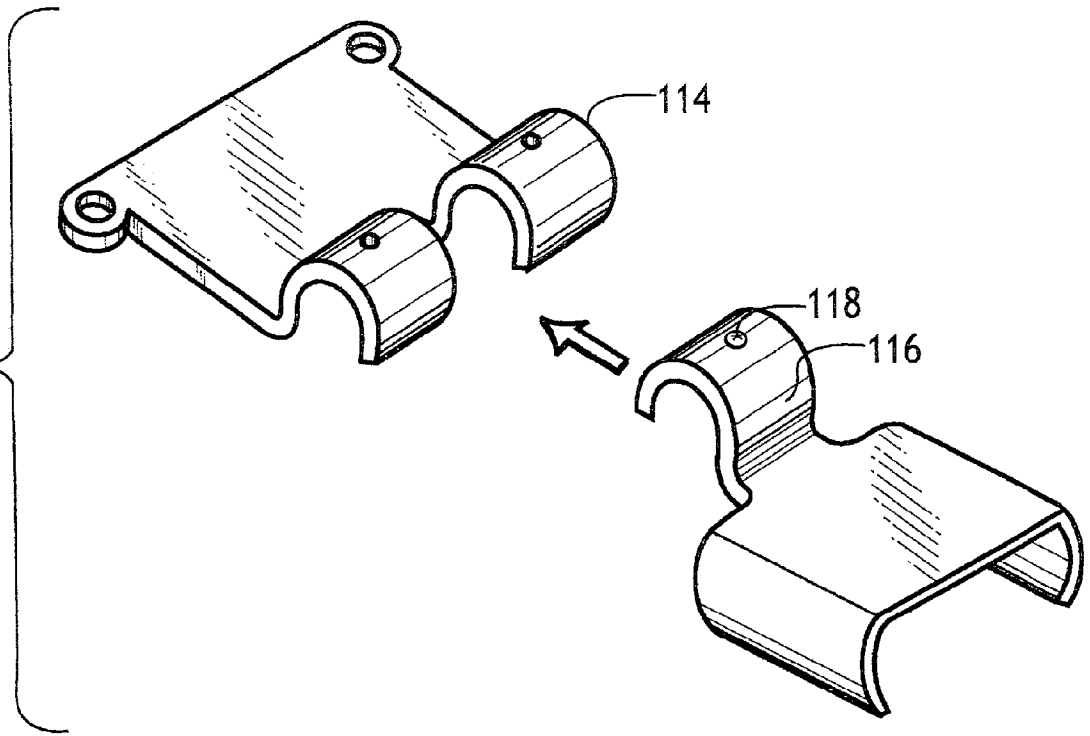
FIG. 17A is an exploded view of another embodiment of the hinge of FIG. 17.
Figure 17B:
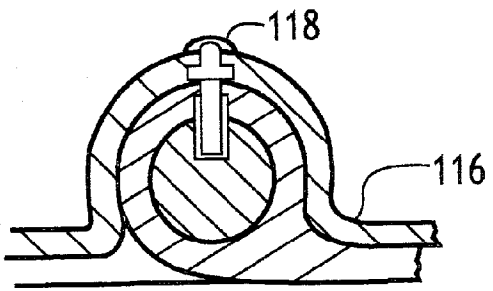
FIG. 17B is a sectional view of the hinge of FIG. 17

FIGS. 17A and 17B illustrate an alternative way of unlocking hinge 15 once locked by providing a plastic (or similar material) cover 116 for covering the hinge paw areas of the lockable hinges to provide protection from the elements, Cover 116 can also provide an external means of depressing locking bar 32 of the hinge (to unlock same) via an external access button 118. (Button 118 can be used with or without such a cover.)

FIG. 18 shows one benefit of having a removable internal handle 74. Removing internal handle 74 provides space for a tree limb, pole, scrap lumber or walking stick 120 to be inserted, which can provide for a full-length shovel handle in the field. This also demonstrates the possibility of providing a folding spear or other edged tool or weapon on the end of a wooden staff, pole, handle or the like.

Figure 19A:
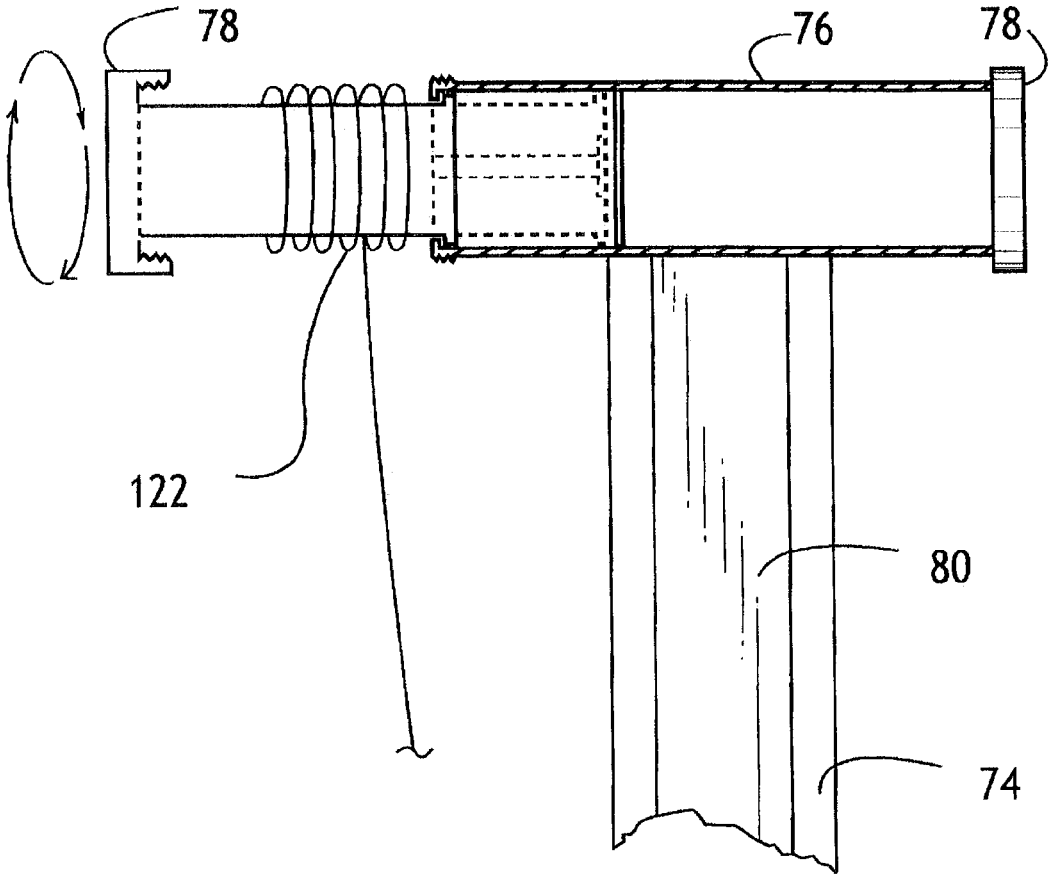
FIG. 19A is a detail plan view illustrating the installation and operation of the fishing reel of FIG. 19.
Figure 19B:
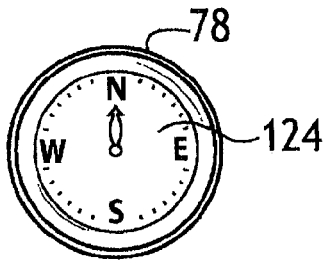
FIG. 19B is a plan view of a compass built into the handgrip of the retractable handle portion of FIG. 19A.

FIGS. 19A and 19B illustrate an alternative embodiment for handgrip 76 and the hand grip storage space 77. Optionally, a reel 122 for fishing line can be contained therein. The reel shown is a simple and basic example based upon a survival fishing tool sometimes known as the "Hobo Fishing Reel". Such a reel can be assembled from commonly available items which even a lost camper or hiker may possess. A thread or string, even a thread extracted from clothing, can be tied to the tab of an aluminum drink can. The string is then wrapped around the body of the can and a hook attached. One can fish by holding the bottom of the can and thrusting the unit toward the water so as to allow the string to unwind and reach the water (with the hook). The string can be reeled in by simply rewinding it upon the can, The survival fishing reel in the handle could be this simple (perhaps using a can containing first aid gear) or embody any number of commercially available fishing reels. As shown in FIG. 19A, end cap(s) 78 can be fitted with female threads to fasten securely to male threads on handgrip 76. FIG. 19B shows compass 124 built into one end cap 78. FIG. 19 shows a spear/harpoon tool 98 doing double duty by providing hole 126 in the tip thereof, allowing fishing line from reel 122 to be threaded through to provide a compact fishing rod/reed combination. Alternatively, a short fishing rod of at least one section (not shown here) could be stored inside internal handle cavity 80 and fitted to the end of one of the tools and/or to hinge 15 at the end of internal handle 74.

FIG. 20 illustrates one method of providing a folding knife or bayonet attached to a military rifle using components of the present invention. Using a hinge 15, hinge platform 26B is attached to the forestock or handgrip of the rifle and the other hinge platform 26A is attached to a knife/bayonet 96 (as shown in FIGS. 14E and 16) so that knife 96 can be folded back into an open cavity on the side of the forestock for storage. When extended into the locked position of the hinge, the knife/bayonet extends beyond the barrel end of the weapon for use as a "fixed bayonet".

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

I claim:

1. A folding tool having at least one tool blade and at least one handle connected thereto with at least one lockable hinge, said lockable hinge comprising:

a center hinge rod;

two hinge assembly components, each comprising a hinge platform and at least one hinge paw attached thereto, said hinge paws each forming a cylindrical opening which is rotationally attached to said center hinge rod so that said hinge paws are adjacent to each other and can rotate in opposite directions;

retaining means to keep said hinge assembly components in position, with said cylindrical openings of said hinge paws rotationally attached to said hinge rod; and mechanical means in said center hinge rod for automatically locking said hinge paws to said center hinge rod when said hinge assembly components are rotated so that they form a single plane or align at a predetermined acute angle.

2. The folding tool of claim 1 having a lockable hinge wherein a first hinge component comprises at least one hinge paw, the second hinge component comprises at least one more hinge paw than the first, said hinge paws are rotationally attached to said rod so that they are mutually intertwined, and one set of said hinge paws is mechanically attached to said center hinge rod to prevent rotation thereon.

3. The folding tool of claim 2 wherein at least one of said hinge paws of said lockable hinge is mechanically attached to said center hinge rod by a mechanical fastener extending laterally through said hinge paw and said rod inside the cylindrical opening of said hinge paw.

4. The folding tool of claim 2 wherein at least one of said hinge paws of said lockable hinge is mechanically attached to said center hinge rod by at least one projection from said rod which interacts with at least one longitudinal groove in the inner cylinder wall of the opening in said hinge paw.

5. The folding tool of claim 1 which further comprises means for unlocking said hinge paws and rotating said hinge components of said lockable hinge to fold said hinge.

6. The folding tool of claim 1 wherein said means for locking said hinge paws to said center hinge rod of said lockable hinge comprise at least one longitudinal locking groove within the inner cylinder walls of each said hinge paw, positioned such that all of said grooves are in alignment when said hinge is in the fully extended position, and a locking bar adapted to enter all of said grooves when thus aligned to lock them in position upon said center hinge rod, wherein said locking bar is positioned in a longitudinal recess upon the surface of said center hinge rod and is fitted with tensioning means to press a portion of said locking bar into said locking grooves when they reach alignment, with a portion of said locking bar remaining within said longitudinal recess to lock said hinge paws to said rod.

7. The folding tool of claim 6, further comprising external means for exerting inward pressure upon said locking rod to force it from said locking grooves in said inner cylinder walls into said longitudinal recess in said center hinge rod to unlock said hinge paws of said lockable hinge and allow rotation thereof about said center hinge rod.

8. The folding tool of claim 1 wherein said tool blade is a shovel blade and said lockable hinge locks when said handle and said blade are in approximately the same plane.

9. The folding tool of claim 8 which includes a plurality of shovel blades for different purposes, each of which can be removably attached to said lockable hinge by mechanical connectors.

10. The folding tool of claim 8 wherein said shovel blade comprises at least one saw edge suitable for cutting.

11. The folding tool of claim 1 which folds for storage with said blade and said handle adjacent to each other and said hinge assembly components parallel to each other.

12. The folding tool of claim 1 wherein said handle is substantially cylindrical in form and is adapted for mechanical connection to a receptacle attached to said lockable hinge.

13. The folding tool of claim 12 wherein said cylindrical handle comprises a crosspiece approximately perpendicular thereto at the proximal end thereof.

14. The folding tool of claim 13 wherein said crosspiece is hollow and comprises at least one removable end cap to permit the storage of additional equipment therein.

15. The folding tool of claim 14 wherein at least one instrument selected from the group consisting of compasses, barometers and altimeters is mounted within said crosspiece and protected by said end cap.

16. The folding tool of claim 1 wherein said tool blade is a cutting blade.

17. The folding tool of claim 16 wherein said cutting blade is selected from the group consisting of knife blades, saw blades and hoes, pickaxes and adzes.

18. The folding tool of claim 1 wherein said handle is substantially cylindrical and hollow in form, containing at least one section which is smaller in diameter and telescopically fitted inside the largest portion of said handle, being adapted to retract for storage and extend and lock into position for use of said tool.

19. The folding tool of claim 18 wherein said smaller diameter handle section locks in place when extended by mechanical locking means.

20. The folding tool of claim 18 wherein said smaller diameter section contains at least one tool having at least one cutting edge therein.

21. The folding tool of claim 20 wherein said tool contained within said section comprises at least one cutting edge selected from knife edges, sawtooth edges and combinations thereof.

22. The folding tool of claim 21 wherein said tool within said section is removably attached to a handle stored within said section.

23. The folding tool of claim 21 wherein said tool within said section is connected to said smaller diameter section as a handle by a lockable hinge comprising:

a center hinge rod;

two hinge assembly components, each comprising a hinge platform and at least one hinge paw attached thereto, said hinge paws each forming a cylindrical opening which is rotationally attached to said center hinge rod so that said hinge paws are adjacent to each other and can rotate in opposite directions;

retaining means to keep said hinge assembly components in position, with said cylindrical openings of said hinge paws rotationally attached to said hinge rod; and mechanical means in said center hinge rod for automatically locking said hinge paws to said center hinge rod when said hinge assembly components are rotated so that they form a single plane or align at a predetermined acute angle.

24. The folding tool of claim 20 wherein a plurality of cutting tool blades are contained within said smaller diameter section and can be removably attached to said handle.

25. The folding tool of claim 1 wherein said handle is substantially cylindrical and hollow in form and adapted to be temporarily removed from said lockable hinge to accommodate tools and/or survival gear therein.

26. A hinged, foldable survival shovel comprising a shovel blade and a handle foldably connected by a lockable hinge, said hinge comprising:

a center hinge rod and two hinge assembly components rigidly attached to said shovel blade and a receptacle for said handle, each comprising a hinge platform connected to said shovel blade or said receptacle, a first hinge component comprising a double hinge paw and a second hinge component comprising a single hinge paw, wherein each hinge paw contains a cylindrical opening therein and the hinge components are arranged with said double hinge paw and said single hinge paw intertwined, with the cylindrical openings therein mounted upon said center hinge rod;

mechanical means for retaining said hinge paws in position upon said hinge rod; and mechanical means in said center hinge rod for locking both of said hinge paws in position upon said center hinge rod when said hinge components are rotated into the same plane, thus locking said shovel blade into a rigid extended position with respect to said receptacle and said handle.

27. The folding shovel of claim 26 wherein said double hinge paw is retained upon said hinge rod by at least one mechanical fastener which passes laterally through both walls of said hinge paw and the center hinge rod occupying the cylindrical opening therein.

28. The folding shovel of claim 27 wherein said single hinge paw is retained upon said center hinge rod by at least one longitudinal projection on said hinge rod which is adapted to fit into a longitudinal groove in the inner wall of said cylindrical opening in said hinge paw to prevent rotation of said hinge paw about said hinge rod.

29. The folding shovel of claim 26 wherein said means for locking said hinge paws in place comprise:

longitudinal locking grooves in each of said hinge paws so arranged as to align into a single groove when said hinge assembly components are rotated to occupy the same plane;

a locking bar contained in a longitudinal recess in the surface of said center hinge rod, fitted with spring tensioning means to press said locking bar outward unless restrained, and adapted to be automatically pressed into said locking grooves when said grooves are aligned, with a portion of said locking bar remaining in said recess in said hinge rod to prevent rotation of said hinge paws relative to said rod.

30. The folding shovel of claim 29 wherein at least one external access means is provided in at least one of said hinge paws for exerting external pressure upon said locking bar to press it inward and remove it from said locking grooves and thereby to unlock said hinge to fold said shovel.

31. The folding shovel of claim 26 wherein said handle is cylindrical and hollow, containing within the hollow portion thereof at least one section of smaller diameter which can be extended lockably to form a longer handle.

32. The folding shovel of claim 31 wherein said smaller diameter section is adapted to contain at least one tool blade, said blade being foldably attached to said section by a a center hinge rod;

two hinge assembly components, each comprising a hinge platform and at least one hinge paw attached thereto, said hinge paws each forming a cylindrical opening which is rotationally attached to said center hinge rod so that said hinge paws are adjacent to each other and can rotate in opposite directions;

retaining means to keep said hinge assembly components in position, with said cylindrical openings of said hinge paws rotationally attached to said hinge rod; and mechanical means in said center hinge rod for automatically locking said hinge paws to said center hinge rod when said hinge assembly components are rotated so that they form a single plane or align at a predetermined acute angle, said section serving as a handle for said tool blade when lockably extended.

33. The folding shovel of claim 31 wherein a crosspiece is attached substantially perpendicular to said cylindrical handle, the crosspiece being hollow and accommodating at least one instrument selected from the group consisting of compasses, altimeters and barometers at one end and fishing apparatus comprising a reel to store, pay out and retrieve fishing line at the opposite end, both ends of said crosspiece being protected by removable end caps.

* * * * *